US008555534B2

(12) United States Patent
Toutounchian

(10) Patent No.: US 8,555,534 B2
(45) Date of Patent: Oct. 15, 2013

(54) IRONING BOARD

(75) Inventor: Darius Rezza Toutounchian, Berkshire (GB)

(73) Assignee: Darius Rezza Toutounchian, Berkshire (GB)

( * ) Notice: Subject to any disclaimer, the term of this patent is extended or adjusted under 35 U.S.C. 154(b) by 87 days.

(21) Appl. No.: 13/002,161

(22) PCT Filed: Jul. 1, 2009

(86) PCT No.: PCT/GB2009/001649
§ 371 (c)(1),
(2), (4) Date: Mar. 28, 2011

(87) PCT Pub. No.: WO2010/001120
PCT Pub. Date: Jan. 7, 2010

(65) Prior Publication Data

US 2011/0167684 A1 Jul. 14, 2011

(30) Foreign Application Priority Data

Jul. 1, 2008 (GB) ..... 0812035.4

(51) Int. Cl.
*D06F 81/12* (2006.01)
*D06F 81/00* (2006.01)

(52) U.S. Cl.
USPC ..... 38/138

(58) Field of Classification Search
USPC ..... 38/103, 137, 138
See application file for complete search history.

(56) References Cited

U.S. PATENT DOCUMENTS

| | | | | |
|---|---|---|---|---|
| 922,446 | A * | 5/1909 | Barber | 38/103 |
| 2,803,897 | A | 8/1957 | Miyamoto | 38/137 |
| 2,999,325 | A * | 9/1961 | Munson et al. | 38/140 |
| 5,016,367 | A | 5/1991 | Breen et al. | 38/135 |
| 5,199,353 | A * | 4/1993 | Szyszko | 101/474 |
| 6,151,817 | A | 11/2000 | Eiben | 38/135 |
| 6,286,237 | B1 | 9/2001 | Toutounchian | 38/107 |
| 7,243,447 | B1 * | 7/2007 | Springer | 38/135 |
| 8,042,462 | B2 * | 10/2011 | Kim | 101/41 |
| 2007/0209242 | A1 * | 9/2007 | Picco | 38/138 |

FOREIGN PATENT DOCUMENTS

| | | |
|---|---|---|
| DE | 1 210 404 | 4/1959 |
| DE | 199 06 239 A1 | 8/2000 |
| EP | 0 659 926 A1 | 6/1995 |

(Continued)

OTHER PUBLICATIONS

International Search Report for corresponding international application Serial No. PCT/GB2009/001649, dated Dec. 4, 2009.

(Continued)

*Primary Examiner* — Ismael Izaguirre
(74) *Attorney, Agent, or Firm* — Westman, Champlin & Koehler, P.A.

(57) ABSTRACT

Ironing board systems comprising an ironing board having an elongate surface for ironing wherein at an end of its perimeter, said surface for ironing has three adjacent equally spaced arc. The ironing board system includes said ironing board and a wing shaped attachment with an edge having an arc complementary to the arcs of the ironing board. The wing shaped attachment is adapted to detachably couple to said ironing board at any of the three adjacent arcs to extend the ironing surface. The ironing board may comprise a rotatable iron rest, and a braking mechanism for restraining the ironing board in open and closed positions.

18 Claims, 16 Drawing Sheets

(56) References Cited

FOREIGN PATENT DOCUMENTS

| | | | |
|---|---|---|---|
| EP | 1 783 268 | A2 | 11/2006 |
| EP | 1 783 268 | A3 | 11/2006 |
| GB | 772 552 | | 4/1957 |
| GB | 2 084 616 | A | 4/1982 |
| WO | WO 2007/018791 | | 2/2007 |

OTHER PUBLICATIONS

Written Opinion for corresponding international application Serial No. PCT/GB2009/001649, dated Dec. 4, 2009.

UK Search Report from corresponding application GB0812035.4, dated Nov. 3, 2008.

* cited by examiner

IRONING BOARD

CROSS-REFERENCE TO RELATED APPLICATION

This Application is a Section 371 National Stage Application of International Application No. PCT/ GB2009/001649, filed 1 Jul. 2009 and published as WO 2010/001120 on Jan. 7, 2010, in English, the contents of which are hereby incorporated by reference in their entirety.

TECHNICAL FIELD

The present invention relates to ironing boards and ironing tables, and more specifically to improvements to the robustness, and ease and speed of use.

BACKGROUND ART

FIG. 1 shows a conventional ironing board 1 comprising an ironing surface 10 supported by a pair of legs 20, 22. The legs 20, 22 extend from the underside of the ironing surface to a pivot 30 and further to feet 40. At the pivot 30 the legs meet in a crossed scissor-like configuration. There are four feet 40 formed at the ends of the pair of legs 20, 22. Adjacent to one end of the ironing surface 10 is an iron rest 50 on which the iron can be placed, and that is not damaged by the heat of the iron.

Commonly, one of the legs is rotatably coupled to the underside of the ironing surface, and the other leg is slidably coupled to the underside of the ironing board. This arrangement allows the ironing board to be collapsed by the user for storage. The collapse of the ironing board is achieved by the movement of the legs which allows the ironing board 1 to be stored in a narrow flat space. To provide a robust surface for ironing, the legs 20, 22 must be held firmly in position when the ironing board is in the upright position for use shown in FIG. 1.

FIG. 2 shows two arrangements used on conventional ironing boards to allow the legs to collapse down flat. FIG. 2*a* shows the underside of a conventional ironing board 1 and how the pair of legs are coupled to the underside. Leg 22 is arranged to rotate about a fixed pivot attached to the underside of the bar. The other leg 20 has a cross beam 65 at the top end of the leg. The cross beam is arranged between a pair of slide surfaces 70. By sliding the cross beam 65 in the direction of the arrow 75, the height of the ironing surface can be adjusted. By sliding the cross beam further in the direction of the arrow 75, the legs will close flat against the underside of the ironing surface. In FIG. 2*a*, the position of the cross beam 65 can be fixed by the lever arm 80. The lever arm is pivoted at its center. Towards the one end of the lever arm 80 are a series of hooks 82 (two shown in FIG. 2*a*) which the cross beam fits into. The hooks 82 prevent the cross beam 65 and legs 20, 22 from sliding and the ironing board collapsing. The hook restraining the cross beam can be released by moving the handle at the other end of the lever arm towards the ironing surface. Conveniently, the handle is biased away from the ironing surface, and the required releasing motion is a squeezing of the handle toward the ironing surface. This causes the lever arm to pivot and the cross beam is released from the hook to allow the ironing board to be collapsed flat.

The prior art device of FIG. 2*a* has a problem in that the legs are only constrained when the hooks 82 engage with the cross beam 65, that is, when the ironing board is in an ironing position with the legs open. Multiple hooks can be used to provide the ironing surface at different heights to allow the user to select the most comfortable. However, the legs are not restrained in the closed position. Thus, a user when picking up the ironing board with the legs in the closed position, from for example, a cupboard, has to grasp the legs to prevent them flying open and hitting the user or surroundings as the ironing board is moved.

FIG. 2*b* shows a common alternative to the above prior art mechanism. In this case, the lever arm with hooks is replaced by a long rod 90 extending from cross beam 65. Intersecting with the long rod 90 is bar 94. The bar 94 is arranged to pivot about axis A through the center of the bar. At one end of the bar 94 is a tab 96 with a circular hole 98 through it, as shown in FIG. 2*c*. The other end of the bar 94 has a handle for turning the rod 94 about axis A. The handle may be biased away from the ironing surface such that the hole 98 in the tab 96 grips the rod 90. When the handle is squeezed toward the ironing surface the tab is rotated bringing the tab 96 perpendicular to the rod 90 effectively increasing the cross-section of the hole as viewed along the rod 90. With the tab perpendicular to the rod, the hole no longer grips the rod 90 and the rod can slide freely through the hole 98. This movement of the rod allows the legs to be moved between a closed or collapsed position, and an upright or open ironing position.

The prior art device of FIGS. 2*b* and 2*c* partly overcomes the problem of holding the legs in the closed position when the ironing board is carried. However, the legs are not held very securely in the closed position because the braking mechanism is only designed to act in one direction to hold the legs in the open ironing position. Furthermore, the device also suffers from a different problem. The mechanism holding the ironing board legs in the open position consists of a hole in a tab of metal gripping against a rod. This does not provide a robust and solid position to the ironing surface, and can sometimes slip thereby lowering the height of the board.

The stability and robustness of the position of the ironing surface is of particular importance when the ironing board is used with a steam generator iron rather than a conventional iron. Such steam generator irons include a large and cumbersome base unit that is filled with 1 to 2 liters of water. Thus, the stability and robustness of the ironing board is particularly important when used with a steam generator.

Another problem with conventional ironing boards such as that of FIG. 1, is that the tip 55 is designed to be useful for ironing a variety of different garments, but this results in the surface not being particularly suited to any go/went. For example, the narrowing of the width of the ironing surface is designed to be useful in ironing trousers because the top of the trouser can be placed over the tip to allow the waist and seat of the trousers to be ironed. However, the tip is also shaped to allow the shoulder yoke of a shirt to be ironed. Because the tip of the ironing board is narrowed, the area of the shoulder yoke that can be ironed at one time without movement of the shirt is small. Hence, ironing shirts requires the shirt to be repositioned many times during ironing. A number of attempts have been made to improve the shape of ironing boards, such as in U.S. Pat. Nos. 5,016,367, 6,151,817, WO 2007/018791, and U.S. Pat. No. 6,286,237, but each of these attempts is limited by ease of use and the shapes of ironing surface that can be provided.

A further problem associated with conventional ironing boards is that the ironing surface cools rapidly. The surface is normally metal covered with fabric, or a fabric coated with foil. The foil is used to reflect the heat, However, with conventional ironing boards thick layers must be ironed on both sides to remove creases, and multiple layers cannot be ironed at once to remove all creases successfully.

Another problem with conventional ironing boards is that after use for several years the fabric top that forms the ironing surface 10 begins to migrate. A user will tend to iron garments using ironing strokes of the same direction. As a result, after several years of ironing, the fabric top will begin to slide towards one side. It is difficult to reposition the top because the fabric adopts the shape given by the edge of the ironing board. Repositioning results in the ironing surface not being flat. Some ironing boards allow the fabric top to be replaced, but this is usually a difficult task and the same problems will only recur again a few years later.

SUMMARY OF THE INVENTION

The present invention provides an ironing board system, comprising: an ironing board having a flat elongate surface for ironing, the surface having a perimeter which at an end comprises three adjacent same shaped arcs or curved portions; and at least one attachment or wing having a first edge complementary to each of said arcs, the system adapted such that the wing detachably couples to the ironing board at any of the three arcs to extend the surface for ironing in different ways. The coupling of the wing results in the ironing surface being extended to form one of a plurality of shapes. By ironing board we also mean ironing tables and the like. The system has advantages in that the shape of the end of the ironing board can be changed to suit the garment being ironed. For example, by coupling one wing to the central arc, the ironing surface is extended to provide a tapered tip suitable for ironing the seat of trousers. By coupling two wings to the outer arcs, the tip of the ironing board is matched to the shoulder yoke of a shirt. In addition because the arcs are the same, a single wing can be fitted interchangeably at any of the arcs.

The wing or attachment may have a shape such that when coupled to the ironing board at any one of the three arcs, a second edge of the wing meets another of the arcs in a continuous curve or line. That is, a second edge of the wing aligns into an arc of the ironing board such that the edge lines up with end trajectory of the arc to continue that trajectory. Thus, the direction of the end of the arc aligns with the direction of the second edge of the wing.

The wing or attachment may have a shape such that when coupled to the ironing board at any one of the three arcs, a second edge of the wing meets another of the arcs at a tangent.

The flat surface of the ironing board is tapered by the outer two of the three arcs, and when the wing is coupled to the ironing surface at the central one of the three arcs the taper may be extended. The taper may also considered to be a wedge shape. This tapered of wedge shape is suited to ironing inside narrow items such as the seat of trousers.

When the wings are fitted to the outer two of the three arcs, the center arc and edges of the wings may form a shoulder yoke shape. The arcs of the perimeter are preferably convex. The first edge of the wing is non-concave.

The wing may be considered to be of generally triangular shape having three sides or edges, one of them being curved complementary to the arcs of the ironing board.

The perimeter of the ironing surface may comprise two sides separated by two ends, wherein of the three equally shaped arcs the outer two arcs meet the sides, and the central one of the three arcs meets the outer arcs at corners.

There is also provided an ironing board or ironing table comprising: an elongate flat ironing surface having a perimeter or circumference comprised of two sides separated by two ends, wherein at one end (the end furthest from an iron rest if provided) the perimeter or circumference is formed of three curved or linear portions, the first curved or linear portion meeting the first side, the third curved or linear portion meeting the second side, and the second curved or linear portion meeting the first and third curved or linear portions at corners. The shape of the ironing surface is optimised for ironing shirts. If curved portions are included, the curvature is matched to the curvature across the shoulder yoke of shirts.

The three curved or linear portions may have substantially the same shape. The radius of curvature of a curved portion may increase towards the extremities of the curved portion. The edge having curved portions is convex.

The ironing board may further comprise receiver means for receiving an attachment for extending the ironing surface. Receiver means may be provided at each of the three portions to receive an attachment at the three portions. By providing three positions at which an attachment may locate, the shape of the tip of the ironing board can be changed to suit the garment being ironed. Furthermore, since all receiver means are the same, a single attachment may be used at all three locations.

The present invention also provides an ironing board/table attachment for extending the ironing surface of an ironing board, the attachment having an ironing surface, the circumference of the ironing surface comprised of first and second straight edges and a third edge, the three edges meet at corners to define a substantially triangular ironing surface, wherein the attachment comprises mounting means arranged to releasably couple the attachment to an ironing board. The third edge may be curved or linear to fit the curved or linear portions of the ironing board described above. If the second portion of the tip is curved, the curvature combined with the extended ironing area provided by the attachments or wings is advantageously matched to the shape of the shoulder yoke of shirts, thereby making ironing of shirts easier because they do not require as much repositioning.

The mounting means may be a retractable tongue.

An ironing board system comprising an ironing board or ironing table described above, and the attachment described above. The attachment may comprise a retractable tongue, and the ironing board may comprise a slot for receiving the tongue, the slot positioned so as to align the ironing surface of the attachment coplanar with the ironing surface of the ironing board. The retractable tongue is used to provide support to the attachment when fitted to the ironing board.

The present invention also provides an ironing board system, comprising: an ironing board having an elongate flat ironing surface; an attachment arranged to detachably couple to the ironing board to extend the ironing surface, wherein the ironing board comprises a plurality of receivers for receiving the attachment at a plurality of positions. The ironing board may have three receivers for receiving the attachment at three positions. The attachment may be coupled to any one of the receivers to provide different shaped ironing surfaces. A plurality of attachments may be provided may also be provided.

When an attachment is coupled to the ironing board at a first position, the extended ironing surface tapers toward a point, but the actual point may be rounded. This tapered shape finds advantage in making it easier to iron the seat of trousers.

The ironing board system may further comprise a second attachment, wherein when the two attachments are coupled to the ironing board at second and third positions, the extended ironing surface widens to form a hammerhead shape. This shape may also be considered to consist of a pair of wings. The shape provides the advantage of fitting the shoulder yoke of shirt to allow the shirt to be ironed without having to reposition the shirt many times.

The perimeter of the ironing surface may have one or more curved portions, and when coupled to the ironing board the one or two attachments meet one or more curved portions tangentially or collinearly.

The present invention further provides an ironing board, comprising: an ironing surface; and an iron rest having a connector coupled to the ironing surface and an iron support arranged to receive an iron, wherein the iron support is arranged for rotation with respect to the connector and about an axis through said iron support. The iron support may also be known as a turntable. The iron support may be a platform, ring or rim that can be rotated. The advantage of the turntable of the present invention is that it allows the iron to be put at rest from a variety of directions, while also being more compact that prior art devices.

The iron rest may be provided adjacent to an edge of the ironing surface.

The present invention also provides an ironing board having an ironing surface, and comprising: a frame or base arranged to support an ironing surface; legs coupled to the frame and arranged to support the frame at a height suitable for ironing; wherein the ironing surface is a layer or sheet covering at least one side of a rigid panel, the rigid panel detachably coupled to the frame. Because the rigid panel is removable, the layer or sheet forming the ironing surface can be changed easily. The rigid panel is preferably flat.

When the rigid panel is mounted to the frame, the layer or sheet is gripped between the rigid panel and the frame preventing movement of the layer or sheet. This arrangement results in the sheet or layer of the ironing surface being clamped between two surfaces preventing movement.

The sheet or layer may be fabric, fabric covered foil, or foil.

The panel may be detachably coupled to the frame by an engageable member. The engageable member may be a foot protruding from the panel and has a ridge for engagement with a notch in the frame.

The present invention also provides an ironing board, comprising: an ironing surface supported by a frame or case; legs to support the frame and arranged to move between a closed position for storing the ironing board and an open position for use of the ironing board, at least one of the legs being slidable with respect to the ironing surface; and a brake assembly arranged to releasably restrain, with respect to the ironing surface, the position of the slidable leg, the brake assembly comprising: a slide rod or connecting rod coupled to the slidable leg, the slide rod extending from the leg to a bearing surface; a cam mounted on a shaft, the shaft having a handle arranged to rotate the cam about the shaft, wherein the shaft is biased towards a first position in which the cam bears against the slide rod pushing the slide rod against the bearing surface thereby restraining the position of the leg.

The handle may be squeezed toward the ironing surface by the user to move it to a second position. In the second position the cam has rotated and no longer causes the connecting rod to bear against the guide thereby allowing the connecting rod to slide. Thus, when the handle is pressed the connecting rod and legs can move.

The connecting rod may be enclosed, fully or partially, within a guide, and the bearing surface may be part of the guide.

The present invention additionally provides an ironing board comprising an ironing surface and legs to support the ironing surface, at least one of the legs being arranged to slide with respect to the ironing surface between a storage position and an open position, the ironing board further comprising a pair of brakes to restrain the position of the at least leg. The pair of brakes may be operated independently, such that the ironing board cannot be collapsed or folded away without operating both brakes. This provides a safety advantage because it prevents a child from operating the brakes inadvertently closing the board. independently operable.

The first brake assembly may have a cam and slide rod arranged to prevent movement of the slide rod in a first direction, and the second brake assembly may have a cam and connecting rod arranged to prevent movement of the connecting rod in a second direction opposite to the first direction. A pair of brakes arranged to operate in opposite directions prevents the legs falling open or closed.

Additionally, the first brake may also provide a smaller braking force in a second direction, and the second brake may provide a smaller braking force in the first direction.

The ironing board may comprise an ironing surface and legs for supporting the ironing surface, at least one of the legs being movable with respect to the ironing surface between a storage position and an open position, wherein the ironing board further comprises a pair of brakes, the first brake arranged to releasably restrain at least one of the legs in the storage position, and a second brake arranged to releasably restrain at least one of the legs in the open position. Because the pair of brakes are required to be operated together to close or open the ironing board, this provides a safety feature preventing a child from closing the legs while the ironing board is in use, perhaps with a hot iron.

There is also provided an ironing board comprising a surface for ironing supported by a rigid panel, the ironing surface formed of a flexible sheet, wherein between the flexible sheet and the rigid panel is a resilient non-permeable interlayer to cushion the ironing surface and prevent steam penetration from the ironing surface to the rigid panel. The steam does not penetrate through to the rigid panel, but is reflected by the interlayer through the flexible sheet. The rigid panel may comprise holes, such as a mesh, or be a solid panel. The flexible sheet may be fabric.

The interlayer may be closed cell foam. The closed cell foam may have a thermal conductivity of less than 0.2 W/m·K. The foam may have a hardness of 5 to 40 on the OO Durometer scale. The foam may be extruded silicon sponge, such as is used for seals and gaskets.

Alternatively, the interlayer may be a resilient material laminated with plastic. The resilient material may be open cell foam, felt, or other matted or non-woven material.

The ironing boards described above may have an ironing surface comprising a flexible sheet covering a rigid panel, disposed between the sheet and rigid panel may be a heat retaining material. The heat retaining material may have a thermal conductivity less than 5 W/m/K, less than 0.5 W/m·K, or less than 0.2 W/m·K. The heat retaining material may be a silicon foam or silicone foam. Such heat retaining material does not cool quickly and thereby provides an increased decreasing duration. The foam is preferably resilient. The foam is also preferably closed cell foam to prevent water or steam penetrating through the foam such that the steam is reflected back from the foam. Alternatively, the foam may be of any kind but is laminated with a membrane through which the steam cannot pass. Preferably the membrane is on the side of the foam closest to the ironing surface such that water is not absorbed in the foam.

Preferably, the foam has a hardness of 5 to 40 on the OO Durometer scale, or even between 5 and 20 on the same scale.

The sheet of the ironing surface may be a felt or felt-like material. The rear side of the felt may be laminated with a polymer or plastic material to retain heat. A foam material may also be used as the heat retaining material and does not necessarily need to be limited to the felt or fabric.

The ironing board attachment described above may also include a heat retaining material as described above.

There is also provided an ironing board comprising: an elongate flat ironing surface having a perimeter comprised of two sides separated by two ends, wherein at one end the perimeter is formed of three portions, the first portion meeting the first side, the third portion meeting the second side, and the second portion meeting the first and third portions at corners.

The three portion may be curved portions. The three curved portions may have substantially the same shapes. The radius of curvature of each curved portion may increase towards the extremities of the curved portion.

A first side may be tangential to the first curved portion, and the second side may be tangential to the third curved portion.

The angle between a first end of one of the curved portions and a second end of one of the curved portions may be 140° to 150°.

The normal to the center of the first portion may preferably be at angle of 140° to 155° to the normal to the center of the third portion, or more preferably 145° to 150°.

The shape of the ironing surface is preferably symmetric about an axis centrally along the length of the surface.

The two sides of the ironing surface are preferably parallel.

Optionally, the ironing board further comprises receiver means for receiving an attachment for extending the ironing surface, a receiver means provided at each of the three portions to receive an attachment at the three portions.

There is also provided an ironing board attachment or wing for extending the ironing surface of an ironing board, the attachment having an ironing surface, the perimeter of the ironing surface comprised of first and second straight edges and a third edge, the three edges meeting to define a substantially triangular ironing surface, wherein the attachment comprises mounting means arranged to releasably couple the attachment to an ironing board.

Preferably, the third edge is a curved edge. The mounting means may be arranged to align the ironing surface of the attachment coplanar with the ironing surface of an ironing board. The mounting means may be a retractable tongue. The first and second straight edges may be at an angle of 60° to 75° to each other, or more preferably at an angle of 65° to 70° to each other.

There is also provided an ironing board system comprising the ironing board described above and the attachment or wing described. The attachment or wing maybe adapted to releasably couple to the ironing board at a plurality of positions. The attachment is adapted to couple to the ironing board at a first position, the edge formed by the second portion of the ironing board meets the first or second straight edge of the attachment tangentially or collinearly. In addition, the attachment is adapted to couple to the ironing board at a second position, the edge formed by the first portion of the ironing board meets the first or second straight edge of the attachment tangentially or collinearly.

The attachment may comprise a retractable tongue, and the ironing board comprises a slot for receiving the tongue, the slot positioned so as to align the ironing surface of the attachment coplanar with the ironing surface of the ironing board.

There is also provided an ironing board system, comprising: an ironing board having an elongate flat ironing surface; and an attachment arranged to detachably couple to the ironing board to extend the ironing surface, wherein the ironing board further comprises a plurality of receivers for receiving the attachment at a plurality of positions.

The ironing board may have three receivers for receiving the attachment at three positions. The attachment may couple to the ironing board at a first position such that the extended ironing surface is tapered. The ironing board system may further comprise a second attachment, wherein when the two attachments are coupled to the ironing board at second and third positions, the extended ironing surface widens to form a hammerhead shape.

The perimeter of the ironing surface may have one or more curved portions, and when coupled to the ironing board the one or two attachments meet one or more curved portions tangentially.

The present invention also provides an ironing surface comprising a sheet covering a rigid panel, wherein between the sheet and rigid panel is a heat retaining material having a thermal conductivity less than 5 W/m/K.

The heat retaining material may be a foam material. The foam material may be silicon foam. The heat retaining material may be a polymer laminated on the sheet. The sheet may be fabric. The sheet may be felt or a felt-like material.

BRIEF DESCRIPTION OF THE DRAWINGS

Embodiments of the present invention, along with aspects of the prior art, will now be described with reference to the accompanying drawings, of which.

DETAILED DESCRIPTION OF THE PREFERRED EMBODIMENTS

Embodiments provide an ironing board or ironing table having an improved tip shape which is also optimised for attachment of removable wings, turntable iron rest, improved materials for the surface of the ironing board, an improved braking mechanism to hold the legs of the ironing board in position, and a removable top to allow the cover to be changed easily and also to hold the cover in position more rigidly. Each of these improvements is described below. Each of these improvements may be included by itself in an ironing board or with any number of the other improvements.

Figure 3:
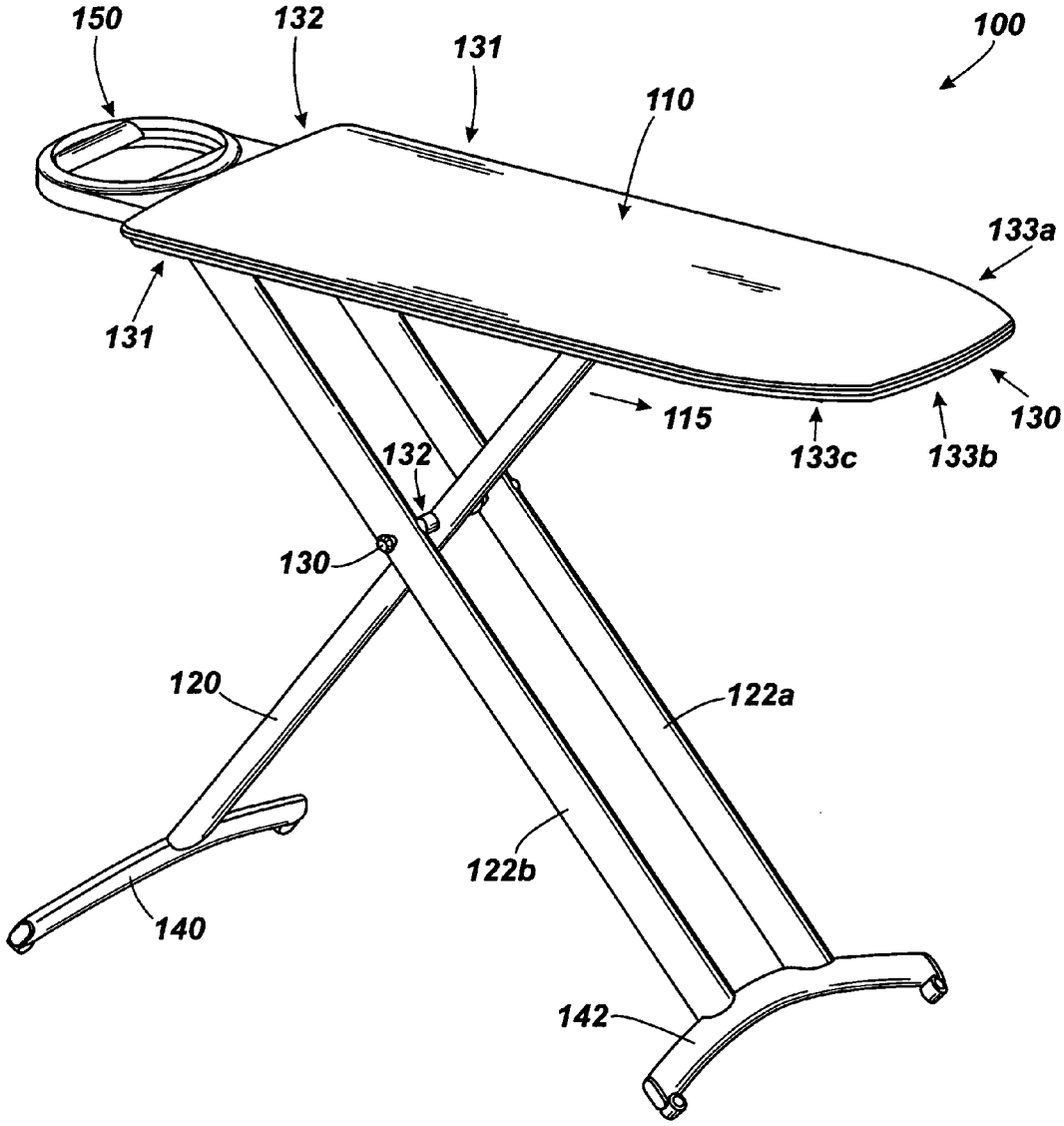
FIG. 3 is an isometric perspective view of an ironing board according to an embodiment of the present invention.

FIG. 3 shows an ironing board 100 having an ironing surface 110 and three linear legs 120, 122*a*, 122*b*. These may be circular or square tubes, solid, or preferably of rectangular cross-section. Two of the legs 122*a*, 122*b* are fixed parallel to each other. The third leg 120 passes between the two legs 122*a*, 122*b*. At the end of each of the legs are feet 140, 142. The feet extend laterally from the legs to provide widely spaced points were the feet touch the floor. Spacing the feet more widely than the legs increases the stability of the ironing board. The feet may extend perpendicularly to the legs or may be curved as shown in FIG. 3. At the ends of the feet where contact is made with the floor, pads may be provided. Legs 122*a*, 122*b* are parallel and the positions where the legs meet foot 142 are slightly spaced apart.

The legs 120, 122*a*, 122*b* meet at a pivot 130 comprised of a circular shaft passing perpendicularly through the legs. Spacing the legs apart on the pivot rod 130 are spacers 132. The pivot rod 130 is held in position by nuts or other fastening means on the end of the rod. The legs can pivot with respect to each other about the pivot, though legs 122*a*, 122*b* are fixed together at the foot and cannot move with respect to each other.

At the top of the legs is provided ironing surface 110. The ironing surface may be supported on a frame. The legs may be connected to the underside of the frame by the prior art means described above, or by further means described below. One of the legs will be pivotally coupled to the underside of the ironing surface or frame, whereas the other leg is able to both pivot and slide. In the current embodiment, legs 122*a*, 122*b* are pivotally coupled, whereas leg 120 can both slide and pivot. In some embodiments, the arrangement may be reversed. The pivotable and slidable arrangement for the legs means that the ironing board can be conveniently folded away. That is, the legs 120 that slide and are locked in the position shown in FIG. 3 for ironing, can be released. The top of the leg 120 can be slid in the direction of arrow 115. As this happens the legs close in a scissor-like manner, the pivot 130 moving closer to the underside of the ironing surface 110 until the legs lie parallel with ironing surface and frame.

The surface of the ironing board is of an elongate or rectangular shape, and may be formed of a metal base covered by fabric, optionally, the metal base may be supported by the frame as described above.

Although the embodiment described above has three legs, it is also possible that embodiments may incorporate two legs, or more than three legs.

Ironing Surface Shape and Wings

Figure 4:
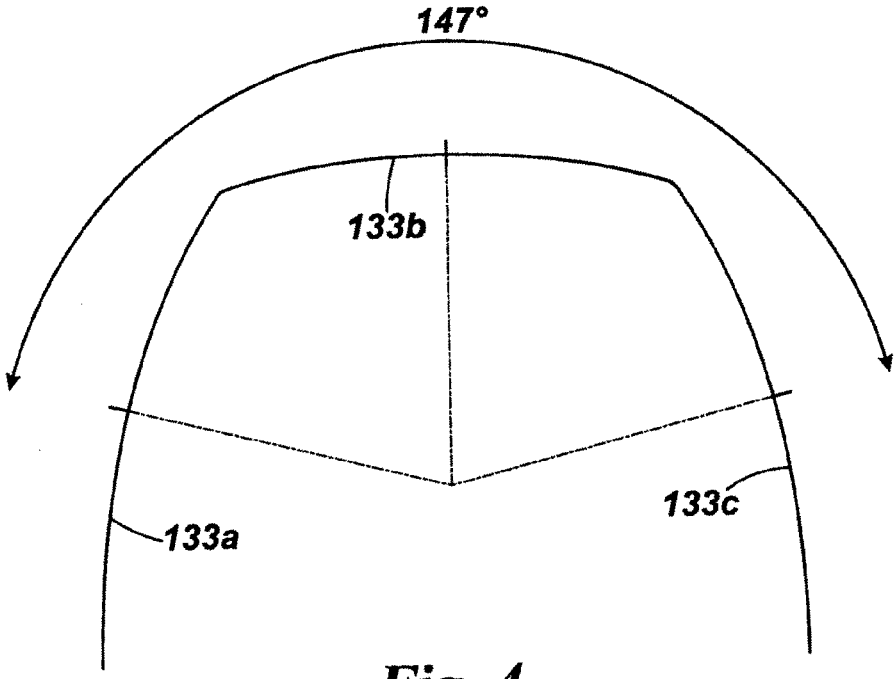
FIG. 4 is a detailed plan view of the tip of the ironing board according to an embodiment of the present invention.

In the currently described embodiment, the ironing surface is based on, but is different to, a normal ironing board shape, that is of an elongate or rectangular shape. The elongate shape has two long sides 131 that are linear along the majority of their length, a short side 132, and a tip 130. Adjacent to the short side 132 may be an iron rest 150 for resting the iron when hot or temporarily not in use. In the current embodiment, the tip 130 has a shape comprised of three similar curved portions 133*a*, 133*b*, 133*c*. These three curved portions are preferably identical. Each curved portion has the same length and same curvature. The curvature is at its greatest at the center of the curved portion and decreases further away from the center, becoming linear at the extremes of the curved portion. Each curved portion 133*a*, 133*b*, 133*c* is symmetric, and the three curved portions themselves are arranged symmetrically about the long axis of the ironing surface. Curved portions 133*a*, 133*c* arranged at the sides of the tip of the board meet the long sides 131 of the board. The decreasing curvature of the curved portion means that portions 133*a*, 133*c* blend to the linear long sides 131. Centre curved portion 133*b* meets the side curved portions 133*a*, 133*c* at corners. FIG. 4 shows the tip of the ironing board in detail. This arrangement has been optimised to fit the shoulder yoke of shirts and blouses. The shoulder yoke is the piece of material that forms the shoulders of the shirt. The curvature of the tip of the ironing board is optimised to fit most, if not all, shirts and blouses. The angle between normals to the two side curved portions 133*a* and 133*c* is preferably between 140° and 155°. In FIG. 4, 147° is shown as this is a particularly preferred embodiment. Thus, the angle between each of the three curved portions is between 70° and 78°, and is preferably around 73-74°.

Figure 1:
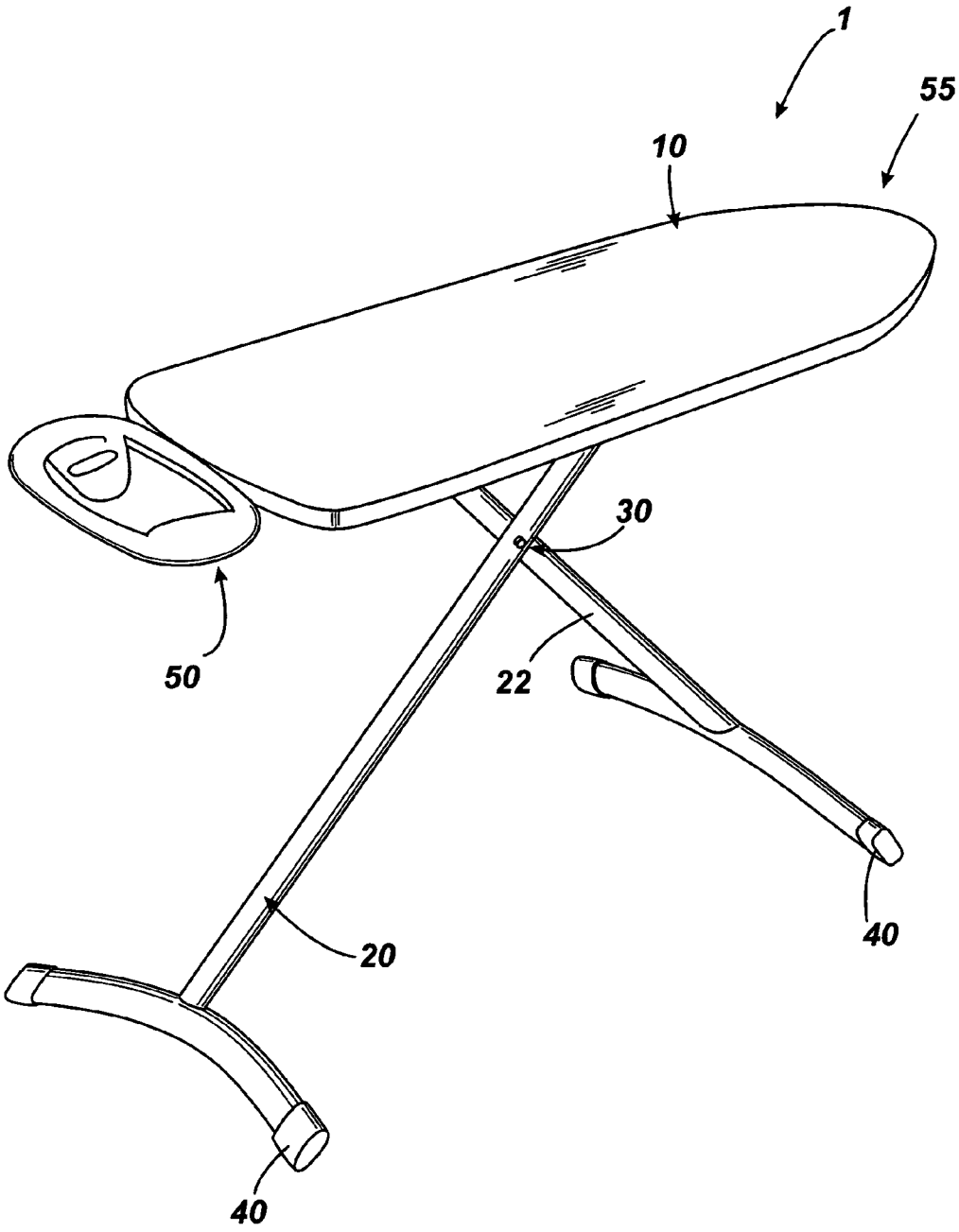
FIG. 1 illustrates an ironing board of the prior art.
Figure 2A:
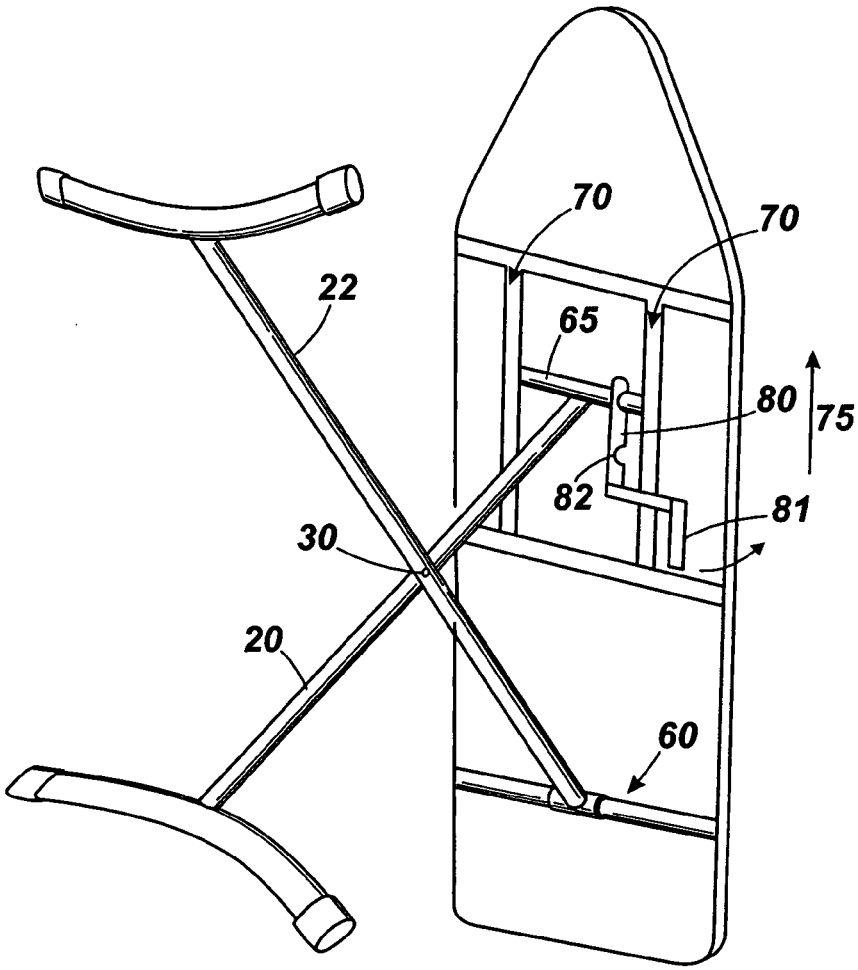
FIG. 2*a* shows the mechanism for locking the legs of an ironing board in open and retracted positions according to a first prior art example.
Figure 2B:
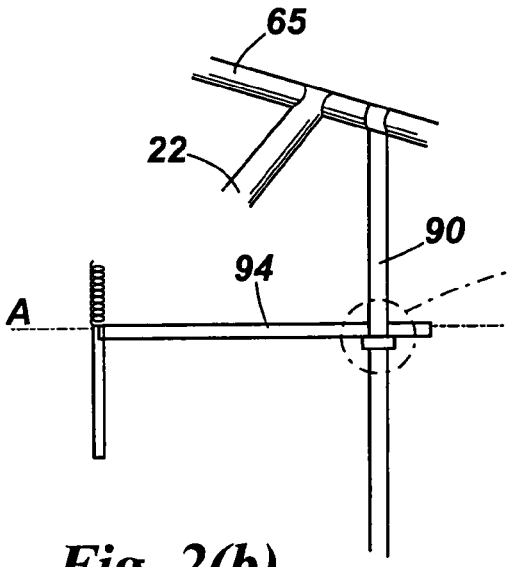
FIGS. 2*b* and 2*c* are detailed views of the mechanism for locking the legs of an ironing board in open and retracted position according to a second prior art example.
Figure 2C:
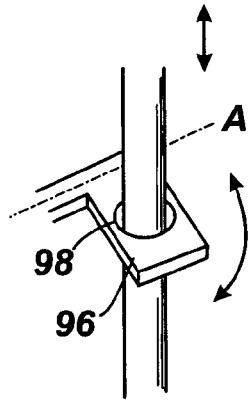
Figure 5:
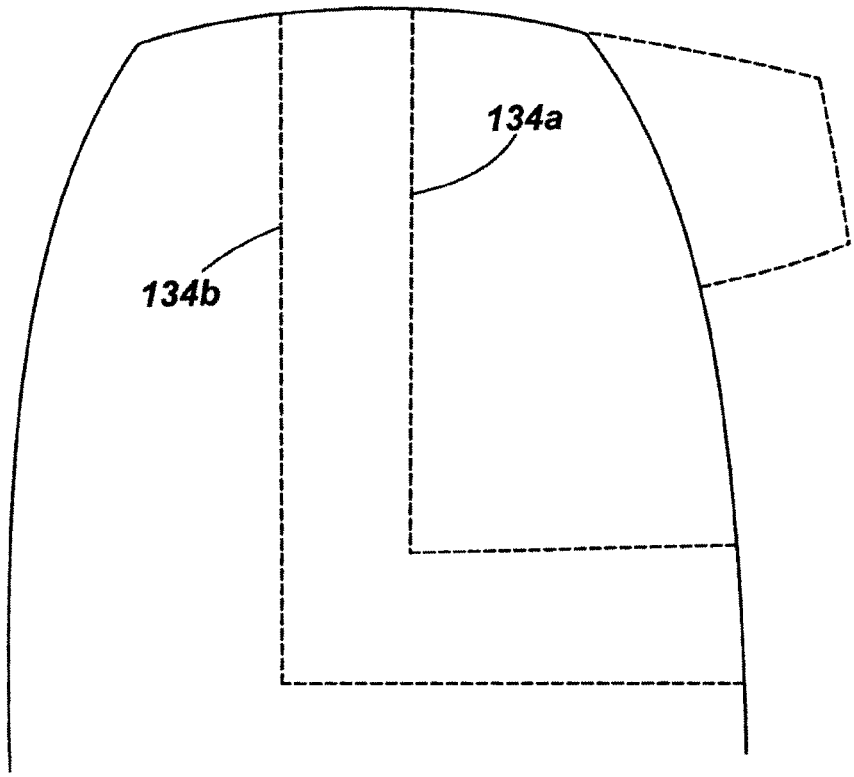
FIG. 5 is a detailed plan view of the tip of the ironing board according to an embodiment, showing the location of a shirt during ironing.

FIG. 5 shows how shirts (sometimes known as dress shirts) of any size are placed on the ironing surface 110. Dashed line 134*a* FIG. 5 shows how a child's shirt may be placed on the ironing board, while dashed line 134*b* shows an adult's shirt. Both shirts require the same curved portion to fit the shoulder yoke of the shirt, but the child's shirt uses a smaller part of the curved portion 133*b* than the adult's. Approximately, and depending on actual size, an adult's shirt will roughly line up so that the middle of the shirt is aligned with the center line of the ironing board, or extend beyond the center line of the ironing board as shown by line 134*b* in FIG. 5. In this way a whole front side (left or right) may be ironed at once without having to reposition the shirt. Conventional ironing boards, such as in FIG. 1, have a pointed tip. This means only part of the top front, or shoulder yoke, of the shirt is supported at any one time, To iron all of one side of the front of the shirt, the shirt will have to be repositioned many times to realign the tip of the ironing board within the shoulder yoke of the shirt. The ironing board of the current embodiment has a curved tip 130 optimised to fit most, if not all, shirts to allow a front side of the shirt to be ironed at once without requiring repositioning of the shirt. This means ironing of shirts is completed more quickly and easily. The ironing board of the current embodiment is also particularly useful for ironing T-shirts, tunics, nightshirts, jumpers etc, or any other garment that fits across the shoulders and may have a shoulder yoke.

In an alternative embodiment three equal sized linear portions may replace curved portions 133*a*, 133*b*, 133*c* to achieve a similar effect.

Figure 6:
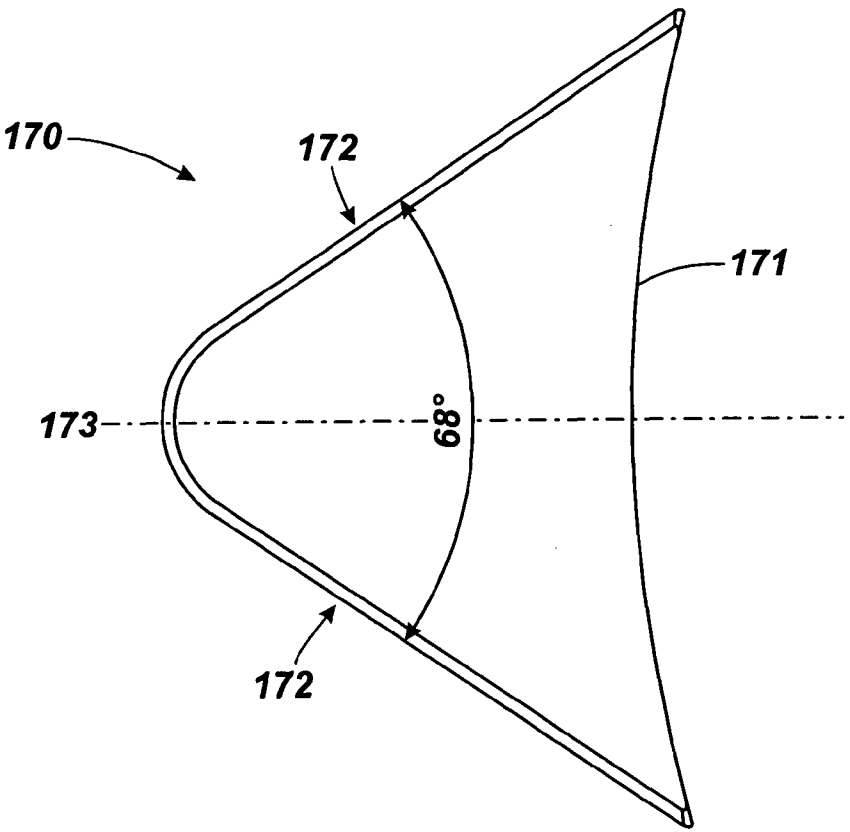
FIG. 6 is a detailed plan view of a wing for attachment to the ironing board.

The embodiment of FIGS. 3 to 5 may also be provided with attachable wings to further improve the ironing of shirts etc. FIG. 6 shows the approximate shape of a wing 170. The wing is of a generally triangular shape but is arranged to fit against one of the curved portions 133*a*, 133*b*, 133*c*. Therefore, the wing has a concavely curved edge 171. The curve of this edge matches that of the curved portion 133*a*, 133*b*, 133*c* of the ironing board of FIGS. 3 to 5. Thus, the curved edge is symmetric and the curvature is greatest at the center of the curve and decreases towards the extremes of the curve such that at the very extremes the edge is approaching linear. Because the curved portions 133*a*, 133*b*, 133*c* preferably all have the same curved form, the wing 170 will fit against any of these portions. The wing also has a pair of substantially linear edges 172 to make up the generally triangular shape of the wing 170. The apex where the two linear edges 172 meet may be rounded as shown in FIG. 6.

Figure 7A:
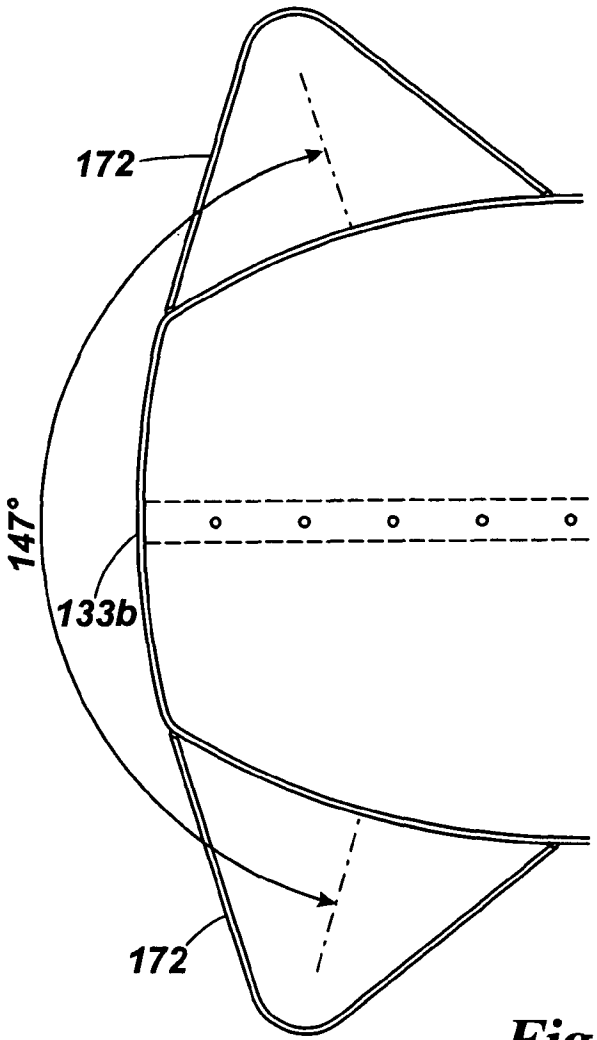
FIG. 7*a* shows the tip of an ironing board with a pair of wings fitted.

FIG. 7*a* shows a pair of wings arranged against side curved portions 133*a*, 133*c* of the tip 130. The linear edges 172 of the wing meet and extend the curved edge portion 133*b*. Thus, the linear edge 172 of one wing, along the curved portion 133*b*, to the linear edge of the second wing, makes a continuous smooth line which is optimised to match the shoulder yoke of many shirts and similar garments. In the embodiment shown in FIGS. 6 and 7*a*, the angle subtended by the linear edges 172 of the wing is between 60° and 75°, and preferably between 65° and 70°, such as 68° as shown in FIG. 6. As shown in FIG. 4, the angle between the two curved portions 133*a*, 133*c* is between 140 and 155°, and preferably 147°. The symmetry line of the wings 173 are also at this angle to each other, as shown in FIG. 7*a*. Based on the above, angle calculations reveal that the angle between the linear edge 172 of one wing, and the linear edge 172 of the other wing is approximately 145°. This is similar to the angle of 147° shown on FIG. 7*a*. In some embodiments these angles may equal.

Figure 7B:
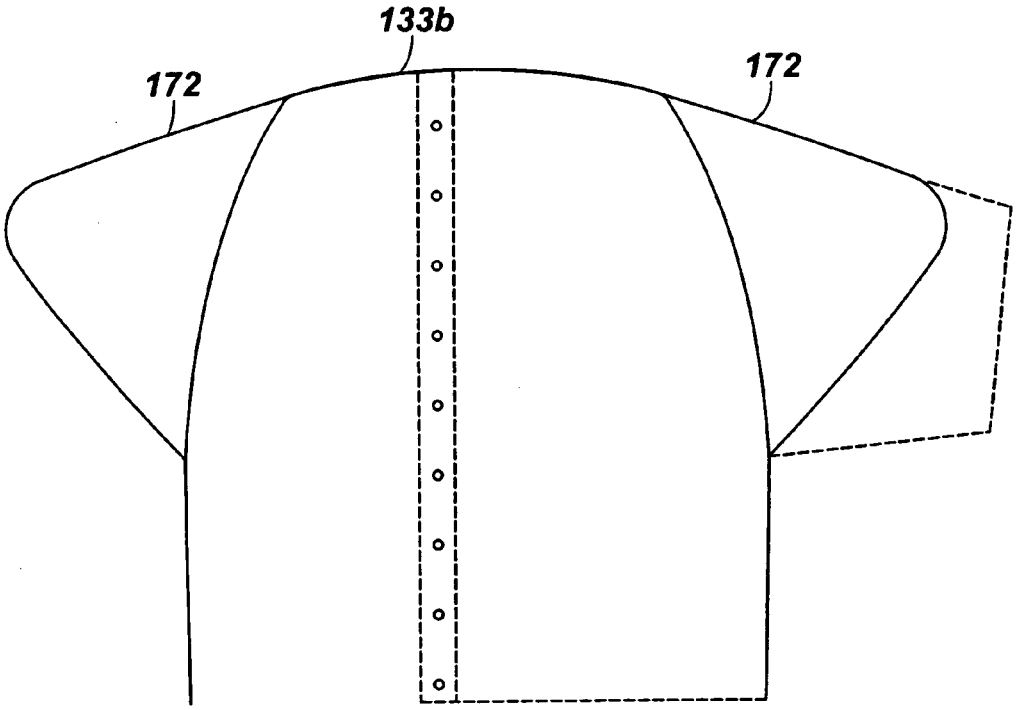
FIG. 7*b* shows the placement of an adult's shirt on an ironing board with wings fitted.
Figure 7C:
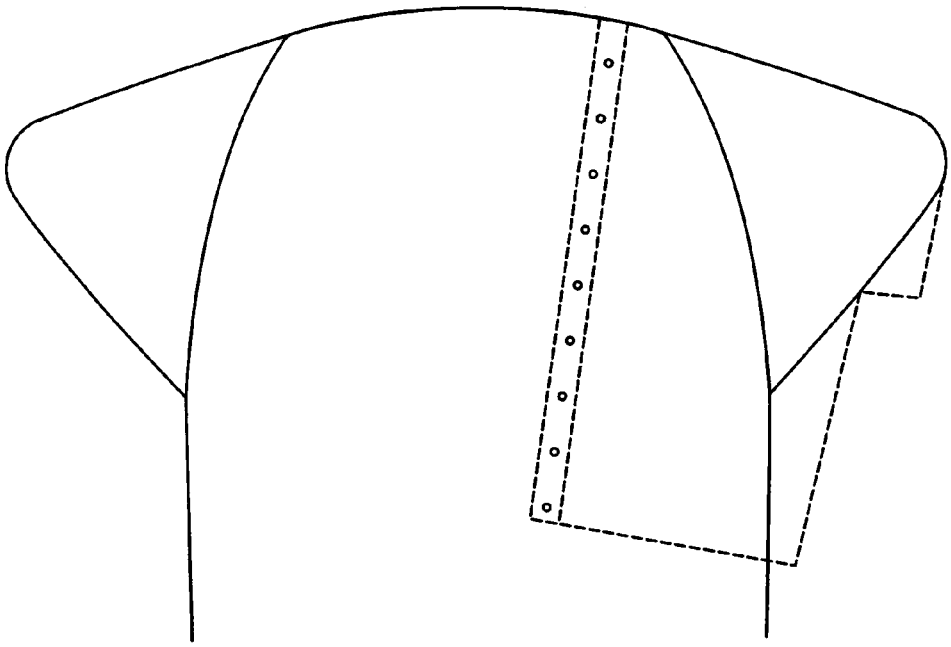
FIG. 7*c* shows the placement of an child's shirt on an ironing board with wings fitted.

FIG. 7*b* shows how a shirt fits to the ironing board. For example, a shirt with buttons and placket down the center of the front of the shirt will align approximately centrally or beyond the center line of the ironing board. The wings partially fill out the ends of the sleeves. The edge, denoted by reference numerals 172, 133*b*, 172 fits in to the shoulder yoke of the shirt. To align the shirt on the ironing board, the shirt should be pulled from one side so that the wing fits into the top of the sleeve. The shirt should also be pulled downwards slightly to fit the curved edge 172-133*b*-172 into the shoulder yoke. One half of the front side may be ironed without requiring repositioning of the shirt. Conventional ironing boards would require the shirt to be repositioned many times to be able to completely iron the shoulder yoke and top of the sleeve. For the current embodiment, the placket of the shirt is shown aligned centrally on the ironing board (FIG. 7). However, the actual position of the placket or center line of the front of the shirt will be depend on the size of the shirt. The position of a child's shirt may differ to that of an adult's as shown in FIG. 7*c*. For a child's shirt the shoulder yoke may be less curved and fit better to the linear portion which is part of the wing. Hence, the shirt may be placed over the tip and wings at angle to the longitudinal direction of the board, as shown in FIG. 7*c*.

Figure 8C:
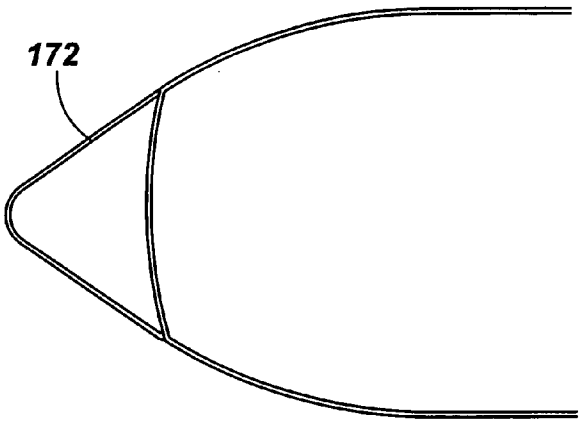
FIGS. 8*a*, 8*b*, 8*c* show the tip of the ironing board in three configurations, respectively no wing fitted, one wing fitted, and two wings fitted.
Figure 8B:
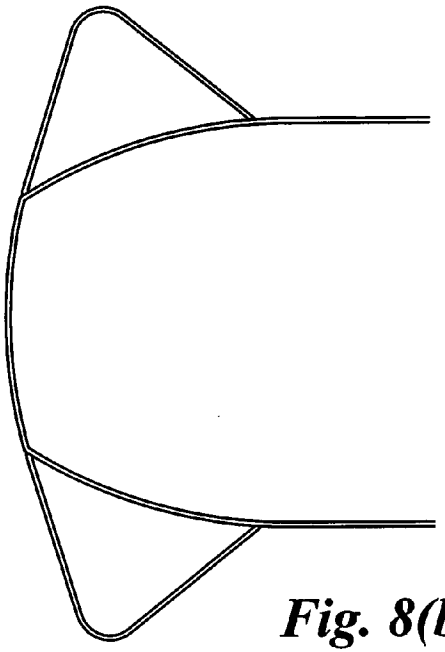
Figure 8A:
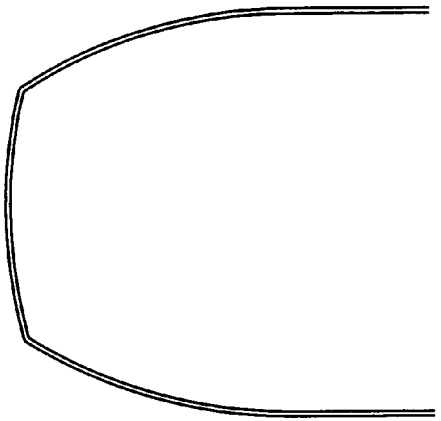

As described above, the tip 130 of the ironing board may comprise three identical curved portions 133*a*, 133*b*, 133*c*. FIG. 7*a* shows wings attached to two of the curved portions 133*a*, 133*c*. A wing may also be attached to the curved portion 133*b*. FIG. 8 shows the tip of the ironing board with no wings attached (FIG. 8*a*), a pair of wings attached (FIG. 8*b*), and a single wing attached (FIG. 8*c*). The single wing attached to the middle curved portion 133*b* provides the ironing board tip with a pointed shape, particularly useful for ironing the seat and tops of the legs of trousers (or pants). The shape of the wings and curved portions are optimised for this purpose. As shown in FIG. 8*c*, the linear edges 172 of the wing blend to meet the curved portion of the tip to provide an edge that forms a smooth continuous line.

In an alternative embodiment where the ironing board is provided with three equal linear portions rather than curved portions 133*a*, 133*b*, 133*c*, the wings may be provided with an additional linear edge rather than the concavely curved edge. The additional linear edge will meet the ironing board tip when fitted to the tip.

If the ironing board is provided with three wings then wings may be fitted to all three curved portions of the tip. In total, the tip and wings may be combined to provide an ironing board with eight different shaped tips. Briefly, they are i) no wings, ii-iv) one wing mounted on the left, in the center, or on the right, v) two wings with one mounted on each aide, vi-vii) two wings with one mounted in the center, and one on the left or right side, and viii) three wings, one mounted in each position.

Figure 9:
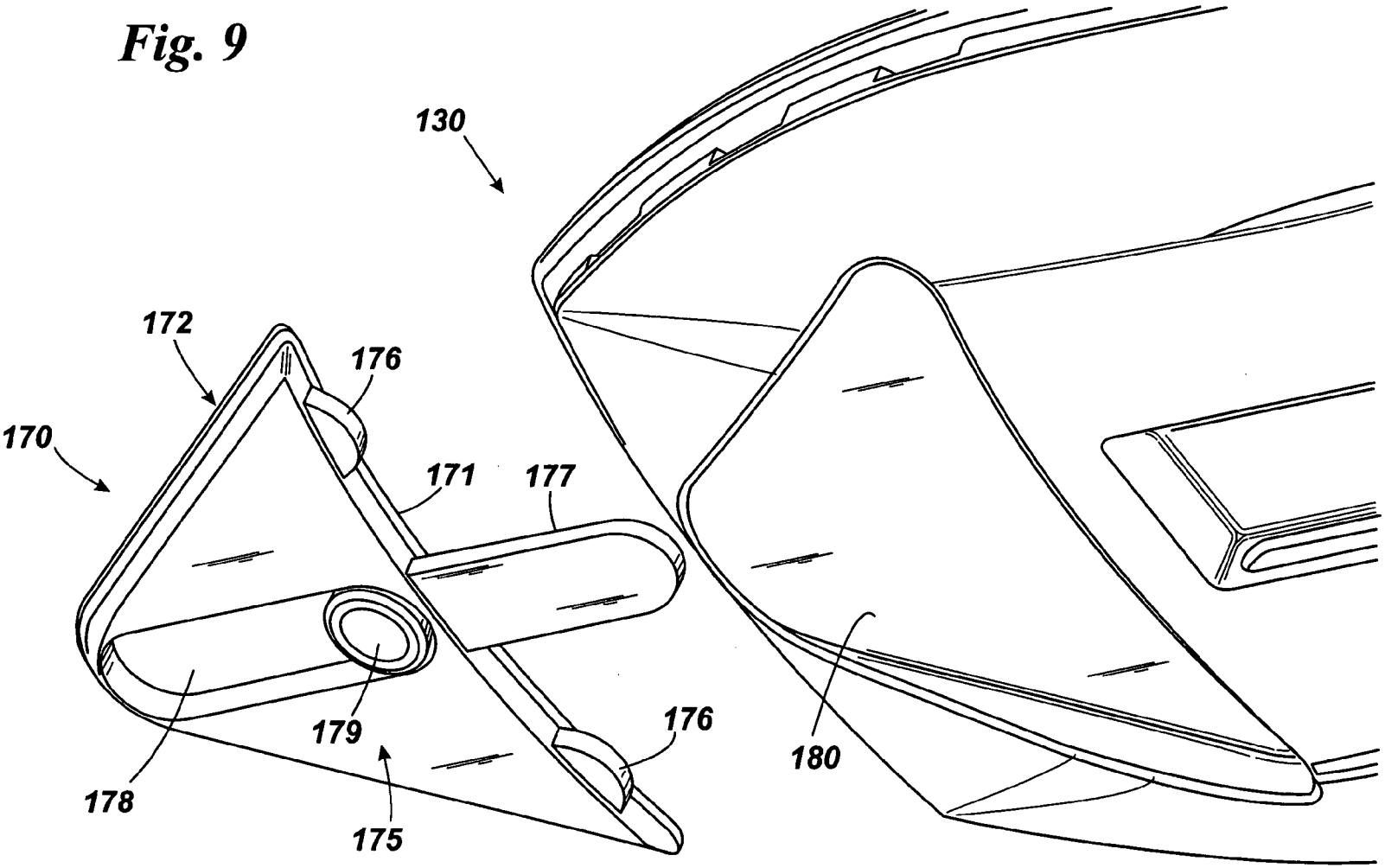
FIG. 9 is an isometric perspective view of the underside of the ironing board and wing according to an embodiment of the present invention.

FIG. 9 shows a wing 170 in detail, along with the tip 130 of the ironing board. The wing has an underside 175 and an ironing surface (not shown). When attached to the tip 130, the ironing surface of the wing meets and is coplanar with the ironing surface 110 of the ironing board to provide a single continuous surface. The wings extend the area of the ironing surface.

The wing 170 is attached to the tip by tongues. There is provided a slidable tongue 177, and two fixed tongues 176. The slidable tongue 177 is provided in a slot 178 in the underside of the wing. The slidable tongue 177 is an elongate slidable tab having a rounded knob or button 179 for actuating the tongue 177. The button is located in the slot 178 and the shape of the slot limits the movement of the tongue 177. The button may take other shapes or forms. Movement of the button from one end of the slot 178 to the other causes the tongue to move from a retracted position to an extended position.

Fixed tongues 176 are semicircular discs that protrude from the curved edge of the wing. When retracted, the slidable tongue still protrudes a small amount from the curved edge 171. The amount the slidable tongue 177 protrudes is substantially the same as the amount the fixed tongues protrude. The end of the slidable tongue is semicircular, to match the shape of the fixed tongue. Other shapes of slidable and fixed tongues are possible.

To attach the wing to the tip of the ironing board, the wing should be positioned to locate the tongues in recesses (not shown) in the edge of the tip 110. The central recess is deeper to accommodate the slidable tongue. The fixed tongues aid with alignment, and the slidable tongue provides most of the support to the wing when fitted to the tip. The tongues may be provided with lugs or ridges (not shown) that fit into keeper notches when the tongues are fully pushed into the recesses in the ironing board tip. The lugs and keeper notches retain the wing securely in the fitted position and prevent it from coming loose. The wing may be removed from the tip by a gentle pulling action to release the lugs from keeper notches. In some embodiments not all of the tongues are provided with lugs. The wings may be fitted to the tip in other ways. For example, the wings may be hinged to the underside of the ironing board, or the wings may slide out of the tip and be retractably stored in the tip.

In the embodiment shown in FIG. 9, after use the wing may be conveniently stored in the cavity 180 in the underside of the board. The cavity in FIG. 9 is shown at the tip end of the ironing board. A second cavity may be included at the other end of the ironing board, or elsewhere on the underside of the board. The cavity 180 is of a generally triangular shape to match the shape of the wing. That is, the cavity 180 has an outline matching the shape of the wing by having two linear edges and a concavely curved edge. The wing is stored in the cavity by first locating the tongues in recesses in the curved edge of the cavity, and then by pushing the wing against the underside of the board. The cavity is deeper at one end than the other such that the wing protrudes outside the cavity. This allows the user to grasp the wing at one end to remove it from the cavity. As shown in FIG. 9, the cavity is deeper at the curved end.

The ironing surface of the wings is provided with a material similar to that used for the ironing surface of the board.

Iron Rest

As shown in FIG. 3, adjacent to the short side 132 of the ironing board 110, and at the opposite end of the ironing board tip 130, there may be located an iron rest 150.

Figures 10A, 10B, 10C, 10D:
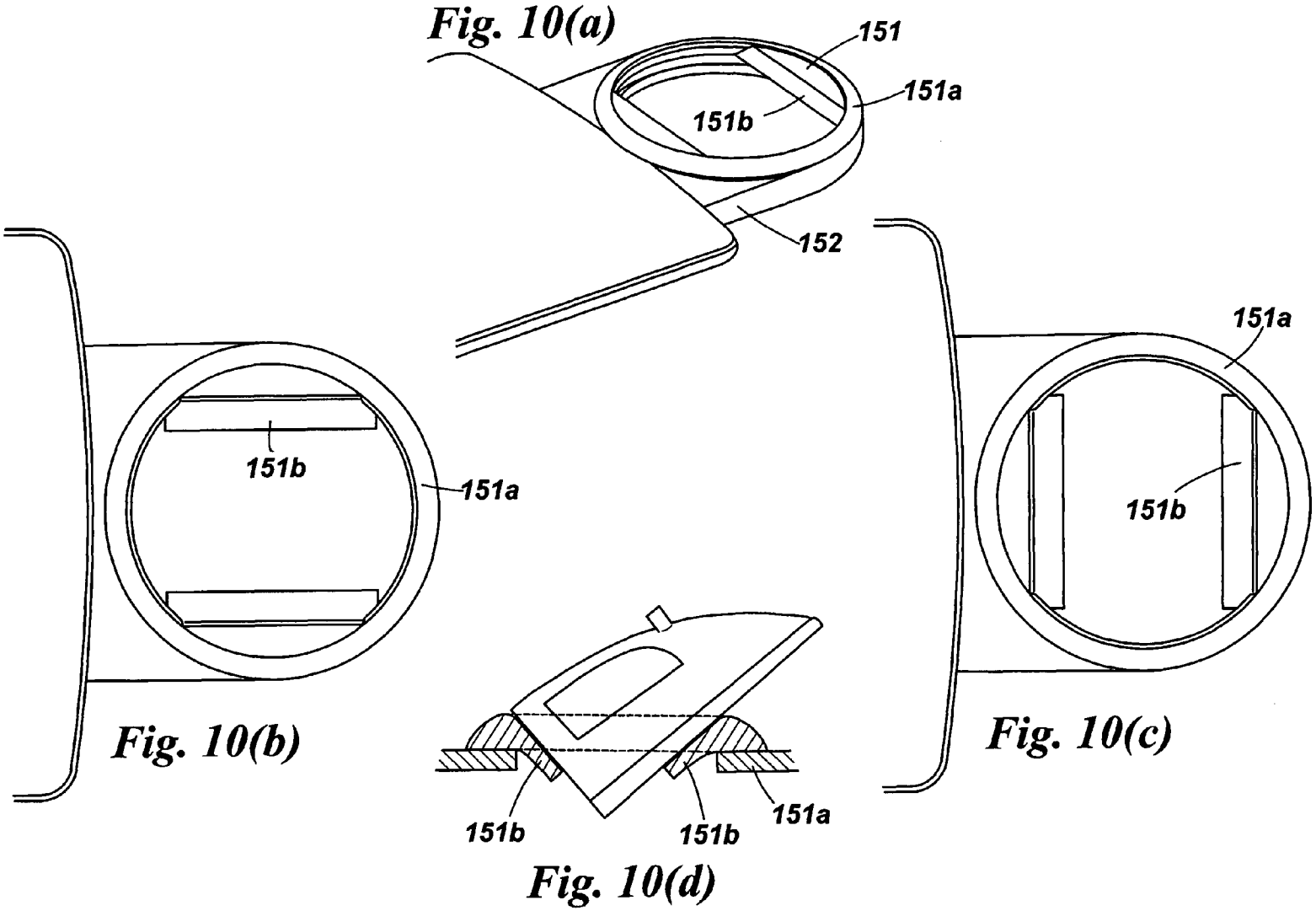
FIG. 10*a* shows in isometric perspective the turntable iron rest of an embodiment of the present invention.
FIGS. 10*b*, 10*c* show the turntable iron rest in two different orientations.
FIG. 10*d* shows the turntable iron rest in cross-section with an iron resting thereon.

FIG. 10 shows in detail an iron rest according to an embodiment. The iron rest comprises a rotatable turntable 151 and a fixed part 152. The fixed part supports the turntable and is connected to the ironing surface or the underside thereof. In some embodiments the ironing surface may be formed of a top surface for ironing which is supported by a frame. In such an embodiment, the fixed part 152 of the turntable is connected to the frame. The fixed part 152 is of a shape similar to half an ellipse (cut along the short axis), but may take many other shapes such as rectangular, square etc. The turntable is circular in shape with a rim 151*a* around the edge. The fixed part 152 has a circular cut-out in which the turntable 151 rests. The rim 151*a* of the turntable rests on the top of the fixed part, but may also have a portion that extends into the circular hole in the fixed part. The rim 151*a* provides alignment of the turntable with the hole in the fixed part 152. Forming chords across the circular rim are pair of flaps 151*b*. These flaps have a horizontal part and an inclined part. The inclined part is normally to be used for resting the iron on such that the heel of the iron rests against and below one of the flaps, with the sole plate of the iron touching the other flap, as shown in FIG. 10*d*. Since the turntable can rotate, the flaps can be oriented at any angle to the ironing board. FIGS. 10*b* and 10*c* show the turntable at two positions spaced by 90°, though any position in between may also be achieved. Alternatively to placing the iron on the iron rest as shown in FIG. 10*d*, the iron can be placed on the rest end on with the iron pointing vertically upward. The flaps are covered with heat resistant material and hence are not damaged by the heat of the sole plate of the iron.

Advantageously, the turntable 151 can be oriented at any angle. This can help the user in putting the iron on the rest. For example, with the iron rest oriented as in FIG. 10*b* or 10*c* it may be awkward to put the iron on the rest. When the user is standing at a midpoint along the side of the ironing board, and reaches to put the iron down on rest 150, the iron will be at an angle to the directions of the turntable shown in FIGS. 10*b* and 10*c*. Thus, the turntable should be rotated by 20-40° to be in alignment with the direction of the user's arm. Furthermore, the turntable can be rotated to be suitable for use wherever around the ironing board the person stands. For example, some people may not stand at the midpoint of one side but closer to one end. Hence the turntable may be reoriented to suit the user. The turntable may also be reoriented to suit left or right handed users whom may stand on different sides of the ironing board.

In some embodiments the turntable may be mounted on bearings or rollers. In the current embodiment, the rim 151*a* retains the turntable by providing surfaces above and below the fixed part which prevent the turntable from being displaced, but allowing it to rotate. The surfaces are bearing surfaces which slide against the fixed part to allow the turntable to rotate. To achieve this arrangement, the rim may be formed of two circular components which fit together to provide a channel to retain the turntable in the circular hole in the fixed part 152. One of the components sits on the top surface of the fixed part, while the other sits below. Alternatively, a one piece turntable 151 may be provided that has a retainer ridge which locates in a channel in the fixed part 152. The channel extends all of the way around the side of the circular hole in the fixed part 152. Hence, as well as retaining the turntable, it also provides a channel in which the ridge slides as the turntable is rotated.

Ironing Surface

Figure 11:
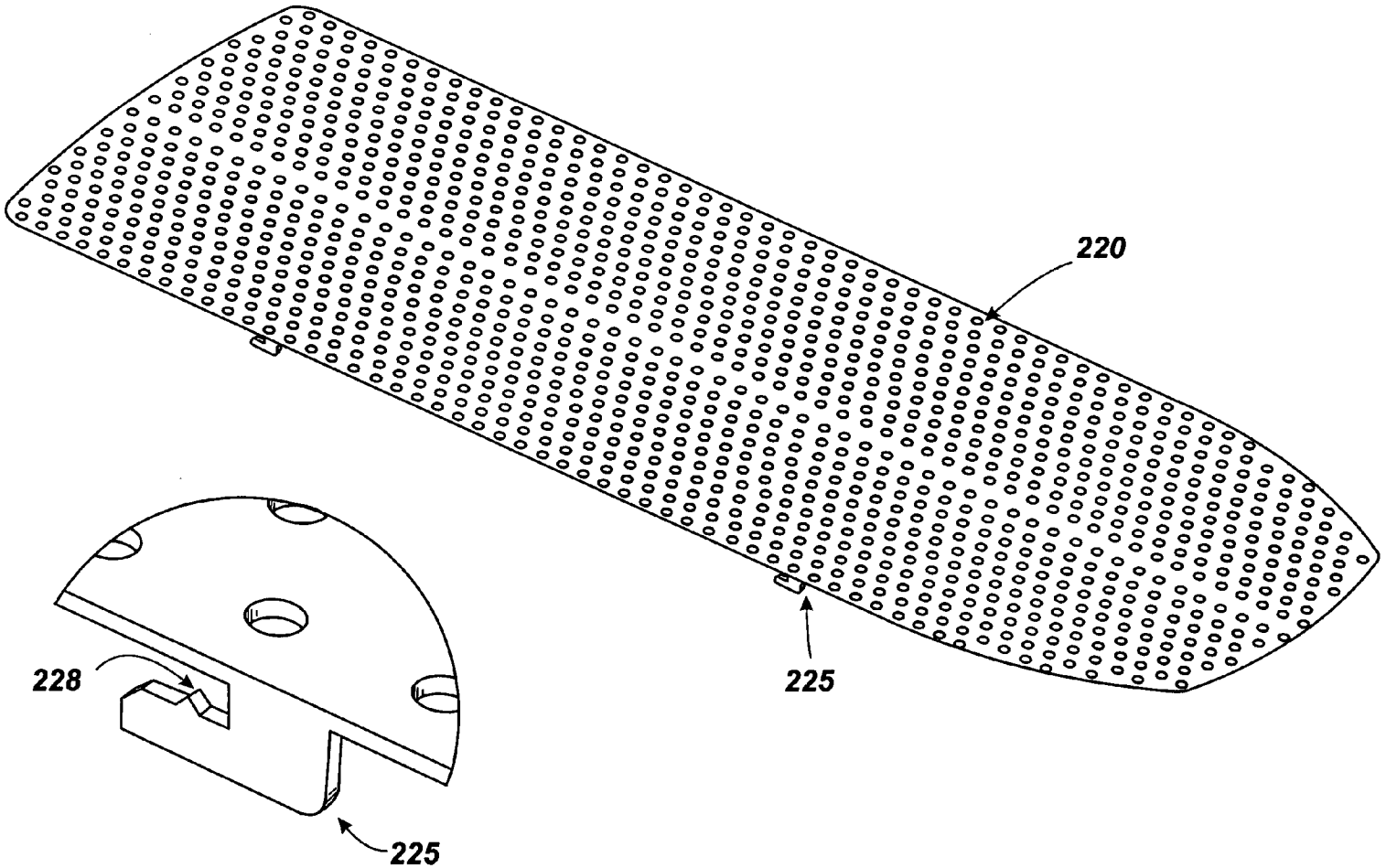
FIG. 11 shows a removable panel that forms the rigid part of an ironing surface.

The ironing surface 110 of FIG. 3 may be comprised of several components. There may be a base or frame part to which the legs are coupled to. The top surface that is used for ironing may be formed of fabric wrapped around a panel 220. Such a panel is shown in FIG. 11. The panel 220 forms the full size of the ironing surface including curved portions at the ironing board tip. The panel 220 has many holes bored through. These holes are to allow steam from the wet or damp garment being ironed to pass out of the garment. The holes also help to reduce weight and material cost. Many holes are provided over each unit of area of the panel, and across the whole of the panel.

The panel 220 is connected to the base or frame of the top by a push and click motion. That is, the panel is provided with feet 225. Preferably, four feet are provided, two on each of the long sides of the ironing surface spaced towards the ends of each side. The feet comprise an ankle that extends downwards away from the panel. Towards the end of the ankle, the feet extend parallel to the longitudinal direction of the panel. All feet point in the same direction. On the horizontal part of the foot is provided a latch or catch 228 which may consist of a small triangular protrusion facing toward the panel 220.

Figure 12:
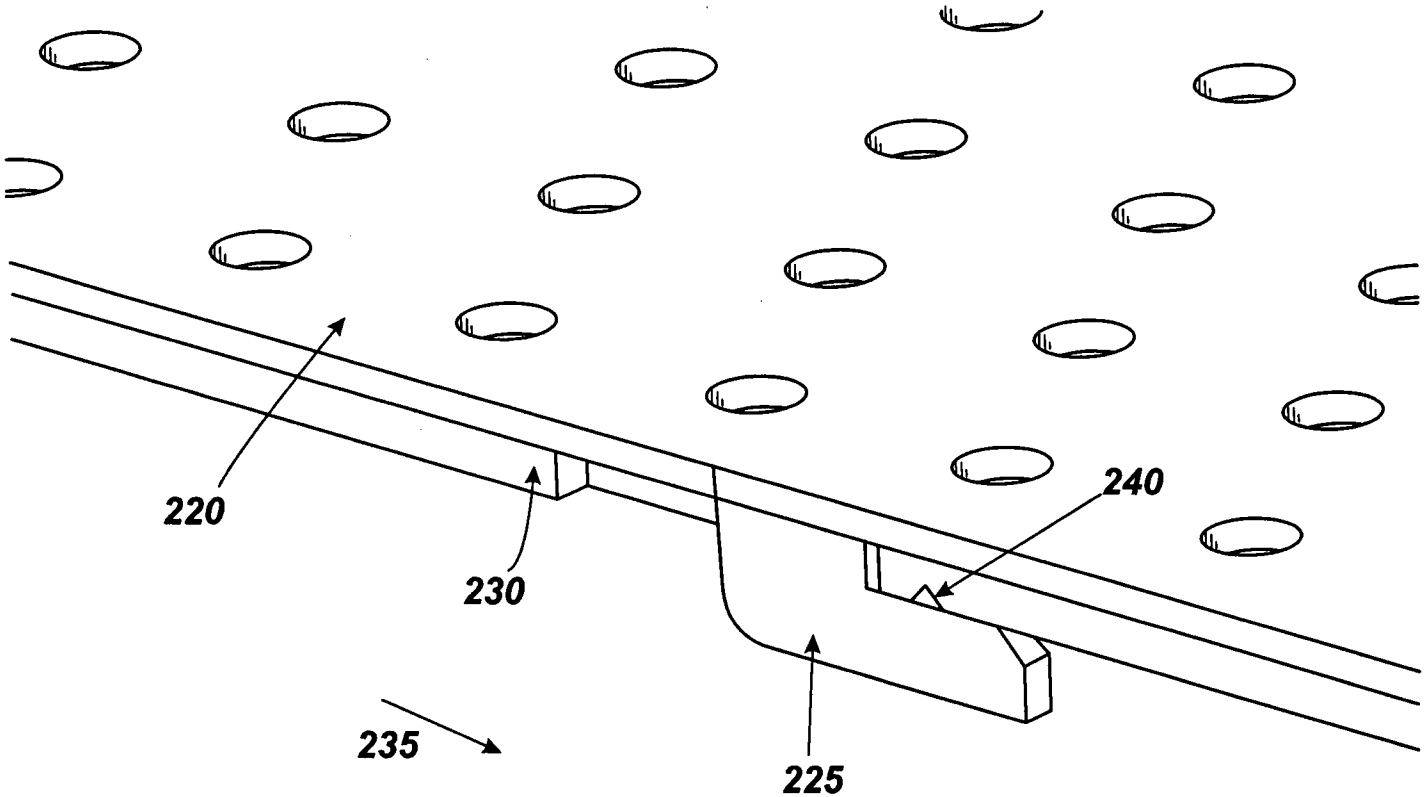
FIG. 12 shows in detail the coupling mechanism for locking the removable panel to the case or frame of the ironing board.

FIG. 12 shows the panel fitted to the frame or base of the ironing surface. The frame 230 is provided with an aperture through which the foot 225 can be passed. When the panel is pushed against the frame or base, and slid in the direction of arrow 235 the catch on the foot engages with a notch 240 in the underside of the base. The notch and latch engage to hold the panel on to the base. All feet are arranged to engage with similar notches on the base at the same time.

Figure 13:
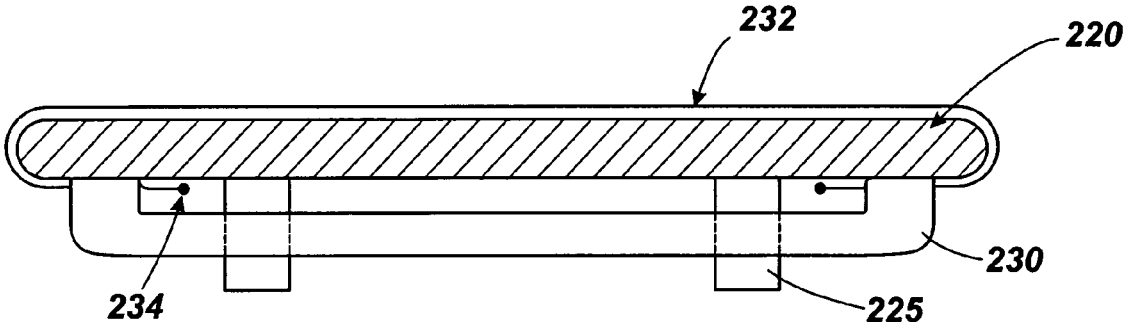
FIG. 13 shows in cross-section the removable panel clamping the ironing surface sheet to the frame.

In FIGS. 11 and 12 the panel or top surface is shown without a fabric covering. FIG. 13 shows in cross-section the panel 220 covered with fabric 232 and fitted to the frame 230. The panel of the embodiment is covered with fabric 232 prior to fitting to the frame 230. The fabric 232 is sized to cover the whole panel and is provided with a drawstring 234 around the edge of the fabric. To fit the fabric, it is draped over the top surface, pulled tight across the surface and wrapped a small amount around the edge and underneath the panel. At this point the drawstring 234 can be pulled tight to pull the fabric 232 tightly against the top surface of the panel. The panel can now be clipped into the frame as described above. Because the panel 220 and frame 230 meet towards the edge of the panel, the fabric 232 is gripped tightly between the panel and the frame when the panel is clipped in position by the cooperating notch and catch pairs. Other engaging means to hold the panel to the case may alternatively be used. The gripping arrangement prevents the fabric moving under continued usage of the ironing board. On conventional ironing boards, the fabric is merely tied by a drawstring under the ironing surface. After years of repeated use and continued ironing in the same direction, the fabric begins to migrate in the direction of ironing. After a long time the fabric has moved so much that part of the underlying metal surface of the ironing board may become exposed. The gripping arrangement of the current top prevents the migration of the fabric surface on the top of the board.

Additionally, to avoid puckering or creasing of the fabric top at the corners of the ironing board, the fabric is tailored to fit the board. In particular, the fabric may be stitched or glued to form a pocket around the ironing board tip and along the long sides of the board. Instead of the drawstring described above, the fabric may be held in position by one or more straps across the board. Where the straps meet they may buckle together, tie together, or be adhered to each by the use of Velcro®.

The ability to remove the panel from the top and easily replace the cover also has advantages in matching the ironing board to the household decor. The fabric may be easily changed to match and coordinate with the colours of the room in which it is used.

The fabric used for the ironing surface of the ironing board may be a non-woven cloth produced by matting, condensing and pressing fibers. The fabric provides a smooth non-slip surface over which garments can be placed for ironing. When a garment is in contact with the fabric over a large area, the fabric holds the garment in place. That is the garment will not slide easily as the iron is passed over it. However, when the garment is lifted from the fabric surface, the smoothness of the fabric means that it can be repositioned easily. This ability to both grip the garment but also to allow the garment to be easily moved makes ironing easier and quicker.

Underneath the fabric outer surface which the garment is placed on for ironing may be an insulating layer. The panel underneath may be metal which conducts the heat away rapidly. However, by adding a heat retaining or insulating layer between the fabric and panel heat can be retained close to the garment. The longer heat is retained close to the garment, the longer the de-creasing effect will be. Thus, having run the iron over the surface of the garment, by retaining heat in the surface of the ironing board, the ironing action will not need to be repeated as many times. In a preferred embodiment, the heat retaining material may be a silicon or silicone foam. The silicon or silicone foam is a poor conductor of heat, and the air trapped in the foam will also trap heat. By reducing the number of times the iron needs to be repeatedly passed over a garment, the speed of the ironing task will be increased. Also, because the board retains some heat the iron may not need to be heated as much, and hence may remove creases sufficiently at a lower heat setting. Thus, the reduced iron temperature combined with the increased speed of ironing will reduce the amount of energy required to iron a garment.

Other types of foam may also be used but they must be able to withstand the high temperatures (up to 200° C.) resulting by close contact with the sole plate of an iron and from contact with steam. The foam should also be a closed cell foam such that the steam cannot penetrate through the material. Conventional ironing board covers use open celled foam to allow the steam to pass through (CH 672152). By providing a foam that is not permeable to steam or water, it cannot penetrate through the foam to the metal frame or panel beneath. The use of a steam generator type iron, or an iron that generates large amounts of steam, may result in the water causing the frame or panel to rust, rot, or become coated in lime scale or other deposits. Thus, the use of closed cell foam causes the steam to be reflected or bounced back from the surface of the ironing board, passing back through the garment, such that it evaporates in the air and does not collect on the surface of the ironing board. As well as preventing rusting etc mentioned above, the steam reflected from the surface results in more efficient steam ironing because the steam passes through the garment twice. Additionally, the reflected steam means water does not collect or pool on the ironing surface. Alternatively, an open cell foam can be used provided it is coated with a thin non permeable membrane.

The foam should also be deformable or resilient such that the ironing surface is soft to the touch. When the iron is passed over the ironing surface the foam cushions the path of the iron. The foam is preferably of a light to medium density offering a hardness measured on the OO Durometer scale and preferably in the range 5-40 on that scale. As an alternative measurement of hardness, the compression deflection should be in the range 0.02 to 0.10 MPa.

Thermal conductivities of 0.06 to 0.12 W/m·K are expected, and preferably around 0.0695 W/m·K which is the value for the silicone foam.

Uncompressed densities are in the range 230 to 280 $Kg \cdot m^{-3}$ (14 to 18 lbs per cubic ft), and preferably around 255 $Kg \cdot m^{-3}$ (16 lbs per cubic ft). Other specifications for the silicone foam used are given in the table below:

| | |
|---|---|
| Elongation at break | 225% |
| Tensile Strength | 65 Newtons |
| Compression Recovery (25% deflection) | 24 hrs @23° C. = 100% after 1 hr<br>24 hrs @100° C. = 95% after 1 hr<br>72 hrs @150° C. = 85% after 48 hrs |
| Temperature Range | −40 to +190° C. |
| Toxicity NES 713 ISS 3 | 14 MM |
| Smoke Index NES 711 | 46 |
| Burn Rate BS4735 | 0.03 mm per second |

The values in this table are measured values from samples tested and some variations from the exact values given above is expected.

Closed cell silicone foam forms a barrier to the steam or water such that it is reflected from the ironing surface. Such foam can also withstand the high temperatures resulting from the ironing process as well as being deformable to cushion the path of the iron.

In an alternative embodiment, the foam can be replaced by other resilient material laminated with a layer through which water or steam cannot penetrate through. For example, a layer of felt can be used to provide the cushioning effect. This is laminated with thin plastic which is preferably flexible. This laminated layer is provided between the rigid panel and fabric sheet. Preferably, the laminated side of the layer faces the rigid panel, but alternatively the laminated side may face the fabric sheet. The latter arrangement prevents water from collecting in the felt and making it damp or wet. As an alternative to felt other types of soft or resilient material may be used. The plastic laminate should be less than half a millimeter thick, and preferably in the range from 10's to 100's μm thick. The felt-plastic is less expensive than silicon foam, and retains the ability to reflect back steam.

Mentioned above are wings 170, the surface of these wings may also be covered with the same fabric. The wings may also include a heat retaining or insulating material underneath the fabric, such a silicon foam. Other types of heat retaining material may also be used, such as silicon rubber.

Braking Mechanism

Figure 14:
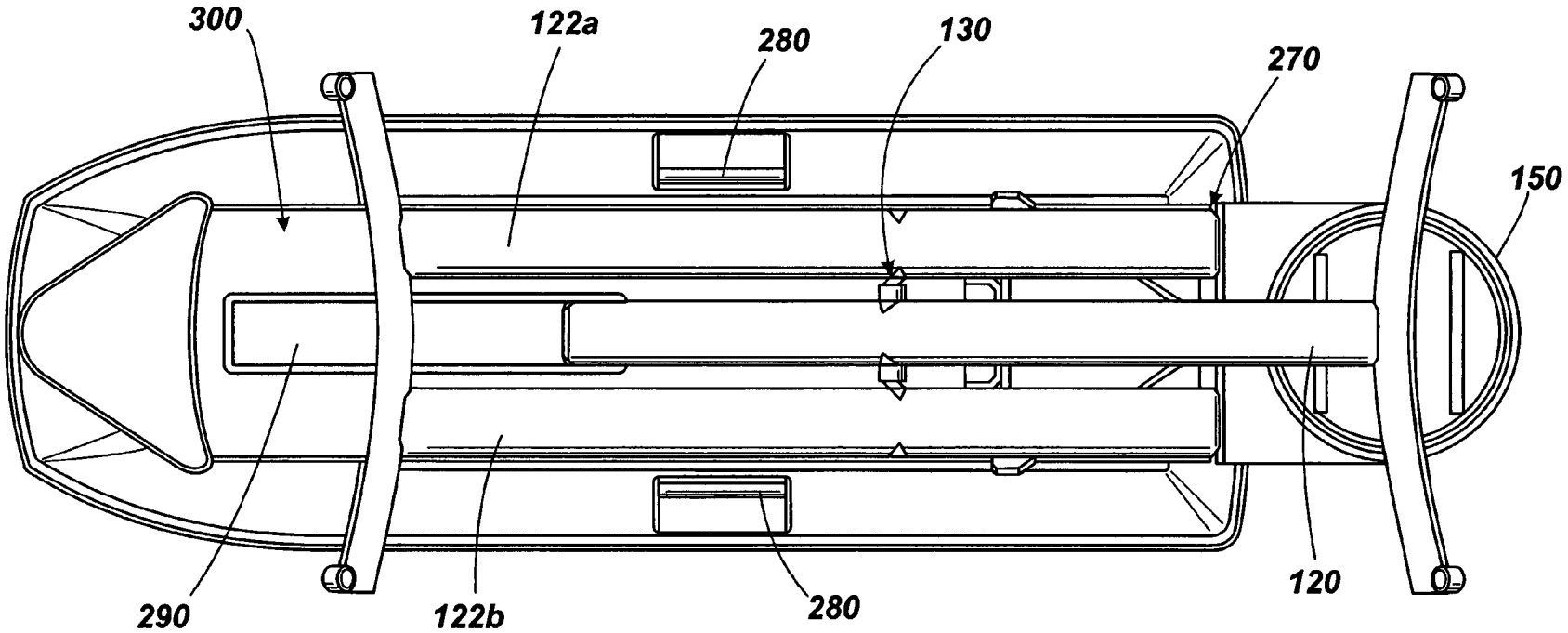
FIG. 14, shows the ironing board from the underside, with legs open.

FIG. 14 shows a view of the underside of an ironing board of FIG. 3. This view is a plan view of the ironing board when it is in the upright position. The legs are shown in their open position ready for use of the ironing board. This view shows some of the features of the mechanism used for restraining the legs in the open or closed position. That is, the open position for ironing, and the closed position for storage of the ironing board. Legs 120, 122*a*, 122*b* are shown in FIG. 14. As described above, the legs 122*a*, 122*b* are coupled by a pivot 270 to the board. Leg 120 meets legs 122*a*, 122*b* at pivot rod 130. The top of leg 120 slides in channel 290. Within case 300 on the underside of the ironing surface there is provided a leg restraint mechanism, or braking mechanism, for holding the leg 120 in the desired position. The mechanism is actuated by handles 280 located in the case 300.

Figure 15:
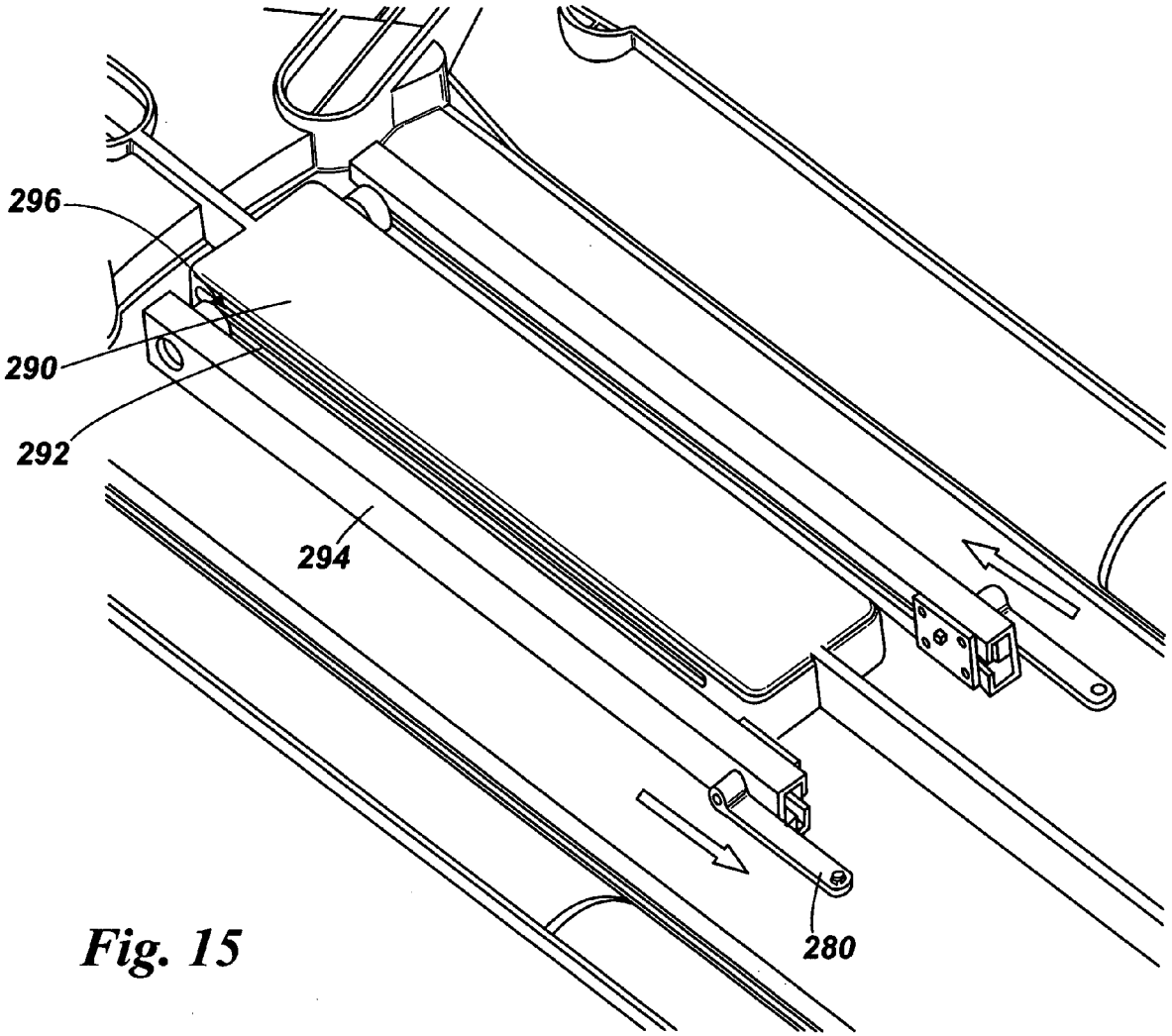
FIG. 15 shows the braking mechanism for restraining the legs in a fixed position.

FIG. 15 shows the braking mechanism in more detail with some of the case 300 removed. FIG. 15 also views the mechanism from the opposite direction to FIG. 14, that is FIG. 15 is viewed from the top side of the case 300 towards legs 120, 122*a*, 122*b*. Hence, the channel 290 shown in FIG. 14, is shown as a rectangular moulding 290 in FIG. 15.

In the sides of the channel 290 are provided slots 292 through which a bar is located. This bar 296 also passes through the end of leg 120. At each side of the channel 290 is provided a hollow guide 294 which has a rectangular cross-section. A slot is also provided in the guide. The slot corresponds with the slot 292 in channel 290. The slot extends along most of the length of the guide such that along this length the guide has a C-shaped cross-section. Bar 296 extends into the corresponding slot in the guide. A spacer may be mounted on the bar between the channel 290 and guide 294. Inside the guide 294, a connecting rod or slide rod 298 couples from the bar 296 to the handle 280, as shown in detail in FIG. 16. The connecting rod 298 is mounted to the bar 296 such that the bar may rotate freely without causing rotation of the connecting rod. However, if the leg 120 is moved, the bar will slide also sliding the connecting rod 298. The connecting rod extends toward the handle 280, but proximal to the bar 296 the connecting rod has two bends. The bends realign the direction of the connecting rod such that its direction does not project through the axis of the bar but is spaced from it. The purpose of the bends is to position the connecting rod 298 close to the inside surface of the guide 294 for as much of its length as possible.

Figure 16A:
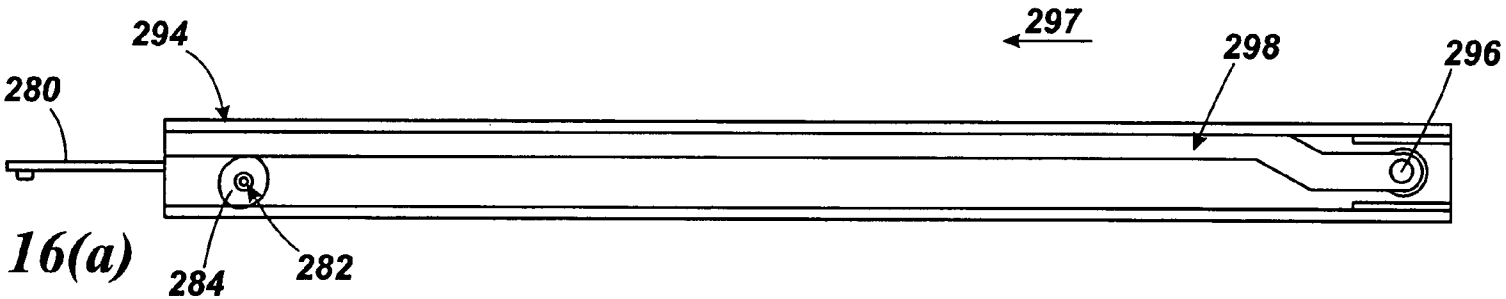
FIGS. 16*a*-16*c* show a guide and slide rod of the braking mechanism.
Figure 16B:
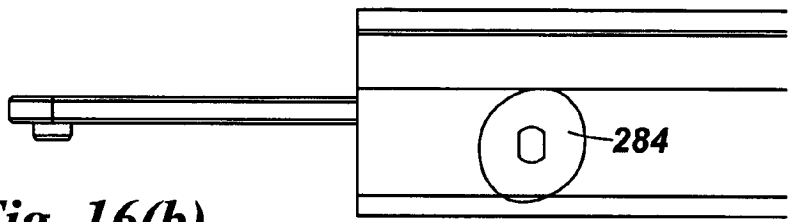

The handle 280 is connected to an axle 282 passing through the guide 294. The handle acts as a lever to turn the axle. On the axle is mounted a cam 284. The cam has an approximately oval shape and is arranged to press against the side of the connecting rod 298. The handle is biased such that when no pressure is applied by the user, the cam pushes against the connecting rod, the opposite side of which is in turn pushed against the inside wall of the guide 294, as shown in FIG. 16*b*. The bias may be supplied by a lever spring, coiled spring or concentrically coiled spring mounted on the axis. Friction between the inside wall of the guide and the connecting rod, and between the cam and the connecting rod, provides a force to stop the connecting from moving. With the connecting rod restrained at a given position, the legs are also restrained at a given position.

Figure 16C:
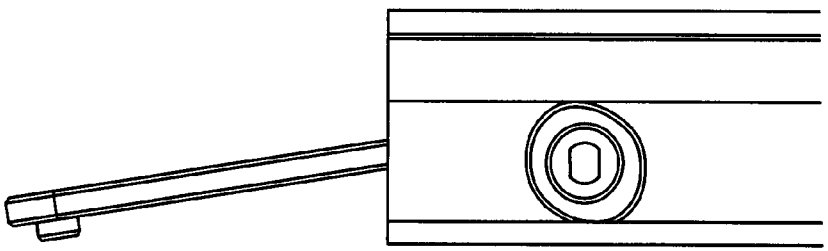

To release the connecting rod 298 to allow the legs to move, the handle is depressed to turn the cam. As the cam turns, the profile of the cam is such that after turning, the part of the cam now closest to the connecting rod has a smaller radius. Thus, the cam no longer pushes the connecting rod against the inside wall of the guide and there is a small gap between the guide and the connecting rod. This is shown in FIG. 16*c*. After the handle 280 is released by the user, the bias will turn the cam back to the position shown in FIG. 16*b* to hold the connecting rod in position.

Figure 17A:
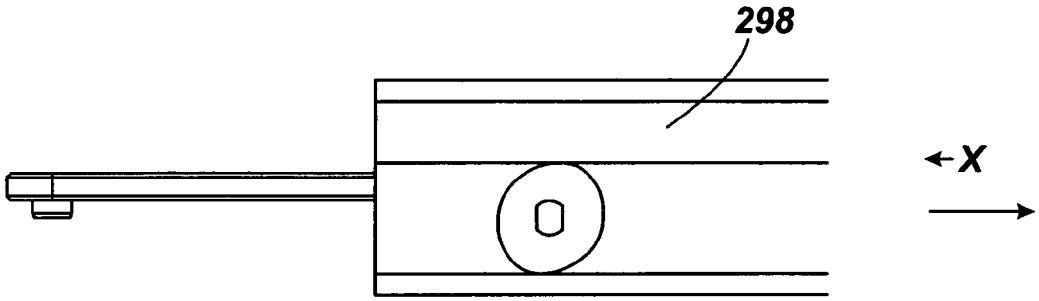
FIGS. 17*a*-17*b* show the different versions of the braking mechanism used on the two sides of the ironing board.
Figure 17B:
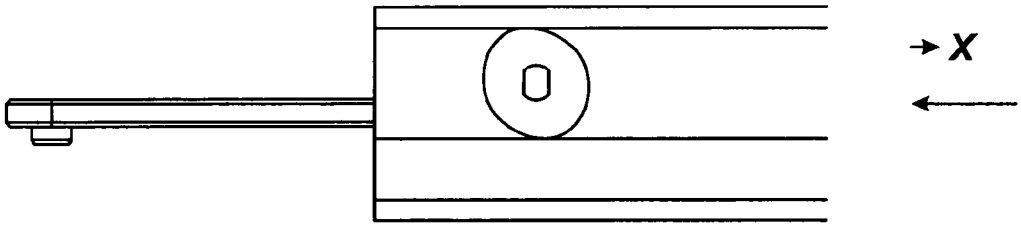

As shown in FIG. 14, the ironing board may be provided with two handles and thus two mechanisms for restraining the leg 120 at given position. The brake mechanism provided on one side of the ironing board is arranged to operate in the opposite direction to the brake mechanism on the other side. The braking mechanism shown in FIGS. 16*a*-16*c* is used on a first side of the channel, and a modified mechanism is used on the other side of the channel. The mechanism for the other side also comprises a connecting rod but the bends are formed in the opposite direction to those on the mechanism of FIGS. 16*a*-16*c*. In FIGS. 16*a*-16*c* the connecting rod passes along the top inner surface of the guide and over the cam. In the mechanism for the other side of the board, the connecting rod passes along the bottom inner side of the guide and underneath the cam, as shown in FIG. 17*b*. Thus, for either mechanism, by pushing the cam handle downward, although the cams are rotated in opposite direction, the same braking forces are applied.

In FIGS. 16*a*-16*c*, the position of the bar 296 indicates that the legs are retracted closed. When the legs are opened to the position for ironing, the bar will move to the left as shown by the arrow 297. Whether the legs are open for ironing or retracted for storage, the bias on the cams will turn them to push the cam against the connecting rod and against the inside wall of the guide. Thus in any restrained position, each connecting rod will be held in position by two pairs of frictionally opposed surfaces, i.e. cam to connecting rod, and connecting rod to guide wall. Furthermore, because of the shape of the cam shown in FIG. 16*b*, this cam will be more efficient at preventing movement in the direction of the arrow 297. The alternative arrangement used for the other guide will be more efficient at preventing movement in a direction opposite to the arrow 297. This is shown in more detail in FIG. 17. In FIG. 17*a*, if a force is applied to the connecting rod to push it to the left, the shape of the cam means that it will push the connecting rod harder against the wall of the guide thereby gripping it tighter. In FIG. 17*b*, the opposite is true, if the connecting rod is pushed to the right the cam will push the connecting rod harder against the bottom wall of the guide holding it tighter. Thus, each braking mechanism provides a directional braking action. The two braking mechanisms together provide bi-directional braking mechanism The braking mechanism described above allows the ironing board to be set to a continuous range of heights for ironing, and not a small number of discrete heights as some prior art devices. In addition, the two braking mechanisms together restrain the iron board at the correct height for the user in a more robust manner than some braking mechanisms. This is especially useful when a heavy steam generator is placed on the ironing board. In addition, the need to push two handles simultaneously to release the brakes provides a safety feature making it difficult for a young child to release both brakes, thereby making the incidence of accidents involving hot irons rarer. An ironing board having the advantage described above may also be provided by using a pair of brake assemblies of the prior art.

In an alternative arrangement, the handles and cams may be configured differently. In the embodiment described above, the handles are squeezed toward the board surface to release the brakes. In the alternative arrangement, the handles are instead pushed towards the edge of the board. The cams are thus arranged to bear on a side surface of the connecting rod rather than the top or bottom surface. Other configurations may also be possible.

The person skilled in the art will readily appreciate that various modifications and alterations may be made to the above described embodiment of ironing board or ironing table without departing from the scope of the appended claims.

The invention claimed is:

1. An ironing board system, comprising:

an ironing board having a flat elongate surface for ironing, the surface having a perimeter which at an end comprises three adjacent equally shaped arcs; and at least one wing having a first edge complementary to each of said arcs, the system adapted for the wing to detachably couple to the ironing board at any of the three arcs to extend the surface for ironing, wherein the wing has a shape such that when coupled to the ironing board at any of the three arcs, a second edge of the wing aligns with another of the arcs.

2. The ironing board system of claim 1, wherein the wing has a shape such that when coupled to the ironing board at any one of the three arcs, a second edge of the wing aligns with another of the arcs at a tangent.

3. The ironing board system of claim 1, wherein the flat surface of the ironing board is tapered by the outer two of the three arcs, and when the wing is coupled to the ironing surface at the central one of the three arcs the taper is extended.

4. The ironing board system of claim 1, comprising two wings, wherein when the wings are fitted to the outer two of the three arcs, the center arc and edges of the wings form a shoulder yoke shape.

5. The ironing board system of claim 1, wherein the ironing board and wing are both adapted for the wing to detachably couple to the ironing board.

6. The ironing board system of claim 1, wherein the radius of curvature of each arc increases towards the extremities of the arc.

7. The ironing board system of claim 1, wherein the angle between a first end of one of the arcs and a second end of that arc is 140° to 150°.

8. The ironing board system of claim 1, wherein the normal to the center of one of the outer of the three arcs is at angle of 140° to 155° to the normal to the center of the other of the outer arc.

9. The ironing board system of claim 8, wherein the normal to the center of one of the outer of the three arcs is at angle of 145° to 150° to the normal to the center of the other of the outer arc.

10. The ironing board system of claim 1, wherein the flat surface of the ironing board is symmetric about an axis centrally along the length of the surface.

11. The ironing board system of claim 1, wherein the wing comprises an ironing surface, the perimeter of the ironing surface comprised of an edge complimentary to the arcs and first and second straight edges, the three edges meeting to define a substantially triangular ironing surface, wherein the wing comprises mounting means arranged to releasably couple the wing to the ironing board.

12. The ironing board system of claim 11, wherein the mounting means is a retractable tongue.

13. The ironing board system of claim 11 wherein the first and second straight edges are at an angle of 60° to 75° to each other.

14. The ironing board system of claim 13, wherein the first and second straight edges are at an angle of 65° to 70° to each other.

15. The ironing board system of claim 1, wherein the wing comprises a retractable tongue, and the ironing board comprises a slot for receiving the tongue, the slot positioned so as to align the ironing surface of the wing coplanar with the flat surface of the ironing board.

16. An ironing board system, comprising:

an ironing board having a flat elongate surface for ironing, the surface having a perimeter which at an end comprises three adjacent equally shaped arcs; and at least one wing having a first edge complementary to each of said arcs, the system adapted for the wing to detachably couple to the ironing board at any of the three arcs to extend the surface for ironing, wherein the ironing surface perimeter comprises two sides separated by two ends, wherein of the three equally shaped arcs the outer two arcs meet the sides, and the central one of the three arcs meets the outer arcs at corners.

17. The ironing board system of claim 16, wherein each of the two outer arcs of the three meets a side tangentially.

18. The ironing board system of claim 16, wherein the two sides are parallel.

* * * * *

UNITED STATES PATENT AND TRADEMARK OFFICE

CERTIFICATE OF CORRECTION

PATENT NO. : 8,555,534 B2
APPLICATION NO. : 13/002161
DATED : October 15, 2013
INVENTOR(S) : Darius Rezza Toutounchian It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 173 days.

Signed and Sealed this
Fifteenth Day of September, 2015

Michelle K. Lee

Michelle K. Lee
*Director of the United States Patent and Trademark Office*